US008833078B2

(12) United States Patent
Galloway et al.

(10) Patent No.: US 8,833,078 B2
(45) **Date of Patent: *Sep. 16, 2014**

(54) COMPRESSED GAS-DRIVEN DEVICE WITH PASSIVE THERMODYNAMIC COMPOSITION

(75) Inventors: Daniel Galloway, Keller, TX (US); Darrell Bevelhymer, Arlington, TX (US)

(73) Assignee: D2BG LLC, Fort Worth, TX (US)

( * ) Notice: Subject to any disclaimer, the term of this patent is extended or adjusted under 35 U.S.C. 154(b) by 1020 days.

This patent is subject to a terminal disclaimer.

(21) Appl. No.: 12/420,531

(22) Filed: Apr. 8, 2009

(65) Prior Publication Data

US 2010/0218492 A1 Sep. 2, 2010

Related U.S. Application Data

(63) Continuation-in-part of application No. 12/395,369, filed on Feb. 27, 2009, now Pat. No. 8,635,873.

(51) Int. Cl.

| | |
|---|---|
| ***F01K 25/02*** | (2006.01) |
| ***F15B 21/06*** | (2006.01) |
| ***F24J 1/00*** | (2006.01) |

(52) U.S. Cl.

CPC ... *F24J 1/00* (2013.01); *F15B 21/06* (2013.01)

USPC ..... 60/650; 60/645; 60/682

(58) Field of Classification Search

USPC ..... 60/407–412, 651, 645, 650, 682

See application file for complete search history.

(56) References Cited

U.S. PATENT DOCUMENTS

| | | | | |
|---|---|---|---|---|
| 2,384,174 | A | 9/1945 | Jones | |
| 2,667,839 | A | 2/1954 | De Carlo | |
| 2,966,776 | A * | 1/1961 | Taga | 60/616 |
| 3,481,149 | A * | 12/1969 | Crane | 62/48.4 |
| 3,602,601 | A | 8/1971 | Zenger et al. | |

(Continued)

FOREIGN PATENT DOCUMENTS

| | | |
|---|---|---|
| EP | 0544520 A1 | 6/1993 |
| KR | 102002000149 | 1/2002 |

(Continued)

OTHER PUBLICATIONS http://www.marchantschmidt.com/item_detail.php?id=95.

(Continued)

*Primary Examiner* — Hoang Nguyen

(74) *Attorney, Agent, or Firm* — Fulbright & Jaworski LLP

(57) ABSTRACT

The present invention is directed generally to a system and method which employ a compressed gas-driven device with a passive thermodynamic composition. Certain embodiments provide a compressed gas-driven (e.g., $CO_2$-driven) device implementation that includes a passive thermodynamic composition which allows for extended use of the device without freezing and without requiring a persistently-maintained, active (e.g., electrically-powered) heating. Further, certain embodiments provide a compressed gas-driven (e.g., $CO_2$-driven) device implementation that includes a passive thermodynamic composition which allows for extended use of the device without freezing and without requiring an ignition heat source (e.g., electrically-powered or pyrotechnic as generator) for heating the device. In one embodiment, a $CO_2$-driven sanitizing device is provided for dispensing a sanitizing solution, wherein a passive thermodynamic composition is employed for enabling substantially-continuous use of the sanitizing device for an extended time without requiring an on-board active heater.

18 Claims, 11 Drawing Sheets

(56) References Cited

U.S. PATENT DOCUMENTS

| | | | | |
|---|---|---|---|---|
| 3,693,367 | A | 9/1972 | Di Peri | |
| 3,797,744 | A | 3/1974 | Smith | |
| 3,878,850 | A | 4/1975 | Gibson et al. | |
| 3,891,149 | A | 6/1975 | Rendemonti | |
| 3,912,809 | A | 10/1975 | Rendon | |
| 3,917,850 | A | 11/1975 | Boucher | |
| 3,993,213 | A | 11/1976 | Burge et al. | |
| 4,048,336 | A | 9/1977 | Winicov et al. | |
| 4,145,889 | A | 3/1979 | Breisch | |
| 4,154,367 | A | 5/1979 | Hanson et al. | |
| 4,454,966 | A | 6/1984 | Hicks | |
| 4,509,957 | A | 4/1985 | Firey | |
| 4,522,190 | A | 6/1985 | Kuhn et al. | |
| 4,627,822 | A | 12/1986 | Esposito | |
| 4,651,903 | A | 3/1987 | Pagliai | |
| 4,802,602 | A | 2/1989 | Evans et al. | |
| 4,854,822 | A | 8/1989 | Darroch | |
| 4,908,166 | A | 3/1990 | Salyer | |
| 4,910,977 | A | 3/1990 | Hilton | |
| 5,149,290 | A * | 9/1992 | Reveen | 446/475 |
| 5,411,053 | A * | 5/1995 | Markham et al. | 137/505.28 |
| 5,517,981 | A * | 5/1996 | Taub et al. | 126/263.01 |
| 5,522,421 | A | 6/1996 | Holt et al. | |
| 5,538,020 | A | 7/1996 | Farrier et al. | |
| 5,611,491 | A | 3/1997 | Bowers | |
| 5,752,661 | A | 5/1998 | Lewis | |
| 5,853,128 | A | 12/1998 | Bowen et al. | |
| 5,986,240 | A | 11/1999 | Schmitt et al. | |
| 5,996,907 | A | 12/1999 | Toetschinger et al. | |
| 6,025,576 | A | 2/2000 | Beck et al. | |
| 6,043,287 | A * | 3/2000 | Nakamura | 514/704 |
| 6,076,359 | A | 6/2000 | Jurcik et al. | |
| 6,094,935 | A | 8/2000 | Stein | |
| 6,142,170 | A | 11/2000 | Belfer et al. | |
| 6,276,579 | B1 | 8/2001 | DeLoach | |
| 6,309,598 | B1 | 10/2001 | Tully | |
| 6,324,293 | B1 | 11/2001 | Muis | |
| 6,378,780 | B1 | 4/2002 | Martens, III et al. | |
| 6,543,462 | B1 | 4/2003 | Lewis et al. | |
| 6,581,412 | B2 | 6/2003 | Pant et al. | |
| 6,695,227 | B1 | 2/2004 | Hayashi et al. | |
| 6,983,598 | B2 * | 1/2006 | Dearman | 60/649 |
| 7,014,127 | B2 | 3/2006 | Valpey, III et al. | |
| 7,163,709 | B2 | 1/2007 | Cook et al. | |
| 7,219,814 | B2 | 5/2007 | Lown et al. | |
| 7,387,265 | B2 | 6/2008 | Hess et al. | |
| 7,415,988 | B2 | 8/2008 | Trettin et al. | |
| 7,427,290 | B1 | 9/2008 | Beavers et al. | |
| 7,448,517 | B2 | 11/2008 | Shieh et al. | |
| 7,451,941 | B2 | 11/2008 | Jackson | |
| 7,475,561 | B2 | 1/2009 | Smolko et al. | |
| 2004/0050877 | A1 | 3/2004 | Ono | |
| 2004/0247528 | A1 | 12/2004 | Schoneberg | |
| 2005/0224596 | A1 | 10/2005 | Panopoulos | |
| 2006/0032944 | A1 | 2/2006 | Hornsby et al. | |
| 2006/0112723 | A1 | 6/2006 | Shelton | |
| 2007/0113171 | A1 | 5/2007 | Behrens et al. | |
| 2008/0053109 | A1 | 3/2008 | Quincy et al. | |
| 2008/0147152 | A1 | 6/2008 | Quincy et al. | |
| 2008/0230632 | A1 | 9/2008 | Fenton et al. | |
| 2009/0010800 | A1 | 1/2009 | Resch et al. | |

FOREIGN PATENT DOCUMENTS

| | | | |
|---|---|---|---|
| KR | 100390348 | | 6/2003 |
| KR | 100395078 | | 8/2003 |
| KR | 100438209 | | 6/2004 |
| KR | 102005000019 | | 1/2005 |
| KR | 100632859 | | 9/2006 |
| KR | 102006011519 | | 11/2006 |
| KR | 102006012409 | | 12/2006 |
| KR | 100796312 | | 1/2008 |
| KR | 100817296 | | 3/2008 |
| KR | 100840254 | | 6/2008 |
| KR | 100845458 | | 7/2008 |
| WO | WO-9007091 | A1 | 6/1990 |
| WO | WO-9319003 | A1 | 9/1993 |
| WO | WO-0148029 | A1 | 7/2001 |
| WO | WO-03053170 | A1 | 7/2003 |
| WO | WO-2007053173 | A1 | 5/2007 |
| WO | WO-2008073557 | A2 | 6/2008 |

OTHER PUBLICATIONS http://www.spray.com/products/.
http://www.mattsonspray.com/industrial/industrial.html.
http://ecom1.planetbike.com/pumps.html.
http://www.ridepdw.com/goods/inflation/shiny-object-co2-inflator.
http://www.amazon.com/s/ref=nb_ss_gw?url=search-alias%3Daps&field-keywords=SKS.
Biomist Power Sanitizing System, pp. 1-13.
Biomist Power Sanitizing System, "Operating and Service Manual," pp. 1-28.
Biomist Power Sanitizing System, "The First Safe Method for Power Spraying an Alcohol-Based Sanitizer," pp. 1-6.
http://www.accurategas.com/athtz.html.pg. 1, Feb. 16, 2009.
http://www.accurategas.com/Uniflow.html.p. 1, Feb. 16, 2009.
CO2 Powered Tools, Jac Pac CO2 Powered Tool Register Kit (J-6901-91), 1 pg.
http://www.teamonslaught.fsnet.co.uk/co2_info.htm.
Biomist Power Sanitizing System, "Optimal Germ-Killing Power," pp. 1-2.
www.offraodtuff.com/co2regulators.php.
www.biomistinc.com.
www.accessdta.fda.gov/scripts/cdrh/cfdocs/cfrl/rl.cfm?lid=81378&1pcd=LRJ.
http://www.oemregs.com/itemdetail.asp?Category_id=1, pp. 1-7.
"Handbook of Compressed Gases", by Compressed Gas Association, Edition :4, illustrated, revised, published by Springer, 1999, pp. 295-311.
International Search Report and Written Opinion issued for PCT/US2010/025608, dated Apr. 21, 2010, 12 pages.

* cited by examiner

COMPRESSED GAS-DRIVEN DEVICE WITH PASSIVE THERMODYNAMIC COMPOSITION

CROSS-REFERENCE TO RELATED APPLICATIONS

This application is a continuation-in-part of co-pending U.S. patent application Ser. No. 12/395,369 titled "COMPRESSED GAS-DRIVEN DEVICE WITH PASSIVE THERMODYNAMIC COMPOSITION" filed Feb. 27, 2009, now U.S. Pat. No. 8,635,873 the disclosure of which is hereby incorporated herein by reference.

TECHNICAL FIELD

The following description relates generally to compressed gas-driven devices and more particularly to a carbon dioxide ($CO_2$)-driven device implementation that includes a passive thermodynamic composition which allows for extended use of the device without freezing and without requiring active (e.g., electrically-powered) heating.

BACKGROUND

Compressed gas, such as carbon dioxide ($CO_2$), has been used to drive or "power" various devices. For instance, $CO_2$ has been employed for powering pneumatic tools, such as tools that are used in automotive applications (e.g., off-road applications, such as air chucks for airing up tires, etc.), construction applications (e.g., for powering nail guns, staple guns, wrenches, saws, sanders, grinders, buffers, drills, hammers, chisels, painters, blow guns, grease guns, caulking guns, shears, ratchets, etc.), industrial applications, manufacturing applications (e.g., semiconductor fabrication applications, etc.), and various other applications. $CO_2$ has also been employed as a propellant, such as for use in dispensing a liquid solution, such as beverages, sanitizing solutions, pesticide solutions, etc. In any such application, whether driving a pneumatic tool or serving as a propellant, $CO_2$ is referred to herein as "driving" (or "powering") the device, and thus any such device is referred to herein as being $CO_2$ driven (or powered). For instance, when being used in a pneumatic tool application, the $CO_2$ drives the operation of the pneumatic tool; whereas when being used as a propellant, the $CO_2$ drives the output of the target solution (e.g., through a spray nozzle or other output interface).

Gases other than $CO_2$, such as nitrogen, are employed in some compressed gas-driven devices. However, $CO_2$ is a particularly popular gas to use for many compressed gas-driven devices because of the often-desired quality that it maintains constant amount of pressure or power until the $CO_2$ storage cylinder completely empties. That is, contrary to nitrogen and many other inert gases, the output pressure generated by $CO_2$ does not change as the amount of $CO_2$ remaining in the storage cylinder reduces, until the cylinder empties of $CO_2$. Thus, largely why $CO_2$ is popular for driving pneumatic tools and as a propellant is because it provides a steady pressure rate. Other inert gases may be used as the gas source for compressed gas-driven devices, but inconsistency in pressure may have to be addressed when using those other gases (e.g., as the gas reduces out of the gas storage cylinder, pressure loss may occur).

$CO_2$ is often employed as an externally-supplied propellant source for dispensing some tar-et solution. For instance, a $CO_2$ storage cylinder may be used for outputting a flow of $CO_2$ as a propellant for dispensing a separately-stored target solution (e.g., liquid solution) that is stored external to the $CO_2$ storage cylinder. For instance, the target solution to be dispensed may be a beverage, sanitizing solution, pesticide, etc. As the $CO_2$ flow is output, the separately-stored target solution (e.g., liquid solution) may be mixed with and/or carried/propelled by the $CO_2$. In contrast, in some instances, $CO_2$ or other gas propellant may be implemented as a propellant within an aerosol application. An aerosol is, by definition, a gaseous suspension of a fine solid or liquid particle. Thus, in an aerosol application, a substance such as paint, detergent, pesticide, etc. is packaged under pressure with the gaseous propellant (e.g., $CO_2$) for release as a spray of fine particles. Accordingly, in the aerosol application, the target solution (e.g., liquid solution) to be dispensed is premixed with and packaged together with the gas propellant in a common storage cylinder. However, in general, $CO_2$ has not gained great popularity for use in aerosol applications due, in part, to corrosive effects that the $CO_2$ has when combined with certain liquids, especially water, on many aerosol containers, thereby reducing shelf-life of the aerosol containers. In view of the above, in a propellant application, $CO_2$ (or other gas) may be used as an aerosol propellant in which it is mixed and stored with the target solution to be dispensed, or it may be implemented as a separate/external propellant source that is stored separate from the target solution to be dispensed.

In general, there are two types of liquefied $CO_2$ cylinders in commercial use: 1) the so-called standard type (sometimes called "gas" or "vapor" type), and 2) the so-called siphon type. Both the standard and siphon types of $CO_2$ cylinders contain liquefied $CO_2$ in them as long as they are filled. A standard cylinder stands upright and releases gas from the evaporation of the $CO_2$ liquid when the valve is opened. Thus, the standard cylinder discharges gas in an upright position, and it discharges liquid when inverted. Siphon cylinders have a dip tube from the valve to the bottom of the cylinder so that when the valve is opened liquid $CO_2$ comes out without having to invert the bottle. Thus, the siphon cylinder discharges liquid when the cylinder is in the upright position. The discharged liquid may be dispensed in certain applications, or it may be converted to gas through heating after it is dispensed from the cylinder. For instance in certain applications, the discharged $CO_2$ liquid is heated to convert it to gas, and the resulting gas is used to drive an end device (e.g., as a propellant or as an air power supply for a pneumatic device). Standard and siphon types of $CO_2$ cylinders are well known in the art, see e.g., "Handbook of Compressed Gases", by *Compressed Gas Association*, Edition: 4, illustrated, revised. Published by Springer, 1999, ISBN 0412782308, 9780412782305, (particularly see pages 295-311).

The operation of $CO_2$ for driving a device (e.g., either for driving a pneumatic device or for serving as a propellant) is well known in the art, and is thus only briefly discussed herein. The following discussion concerning the operation of $CO_2$ for driving a device is intended only for general informative purposes to aid the reader in understanding that operation of the $CO_2$ for driving a device generally results in reduced temperature/cooling, and the discussion is not intended to be limiting of the scope of the concepts presented herein in any way. During typical operation of $CO_2$-driven devices, the liquid $CO_2$ stored in the $CO_2$ storage cylinder converts from liquid to gas. The conversion from liquid to gas causes a reduction in temperature, which causes the cylinder to get cold. During typical operation, there usually exists both liquid and gas in the $CO_2$ storage cylinder. As $CO_2$ gas and/or liquid is output from the cylinder to drive a device (e.g., either to drive a pneumatic device or to act as a propellant), remaining liquid in the cylinder evaporates to restore the pressure in the cylinder. Just as water evaporating from a person's skin cools the person off, the evaporation of the liquid $CO_2$ in the storage cylinder cools off the cylinder (liquid and gas). Over extended use, the cylinder and/or other components of the device will freeze (which ceases operation of the device), unless some counter-acting heating source is employed. As another description of this cooling process, the molecules of the liquid $CO_2$ are generally in constant motion, some moving faster than average, some moving slower. The average speed of the molecules is related to temperature, and the higher the temperature, the faster they generally move. However, when molecules evaporate from a liquid the faster "hot" molecules convert into the gas phase. As these molecules convert to gas, they lose some of their speed breaking away from the liquid, but the liquid that is left behind is colder than it previously was because it lost its "hot" molecules to the gas.

Thus, conventional compressed gas cylinders (which refers broadly to any storage vessel or container) typically have liquefied gas under its own vapor pressure at ambient temperature. As the vapor is withdrawn from the cylinder, the liquid evaporates at an equivalent rate to account for the decrease in pressure. This consumes energy from the remaining liquid in the tank. In the absence of some thermal counter-activity (e.g., heating of the cylinder), the liquid temperature drops, which may lead to a corresponding drop in the vapor pressure. If no thermal counter-activity is taken and the gas cylinder is outputting its gas (e.g., for driving a device) substantially continuously for an extended period of time, the reduced temperature will result in freezing of the cylinder or other components of the device, which causes proper operation of the device being driven by the gas to deteriorate or cease.

Various approaches have been taken with regard to the temperature reduction and potential freezing of $CO_2$-driven devices. One approach, which does not attempt to alter the reduction in temperature, but instead attempts to insulate the cold temperature (e.g., protect a user's hands from the cold $CO_2$ cylinder, etc.) is to cover the cylinder in a thermal insulation material. Merely using insulation does not keep the cylinder at sufficiently high temperatures (e.g., to avoid freezing over extended use) and may actually prevent ambient heat from heating the cylinder, which may encourage faster freezing of the $CO_2$ cylinder in some instances. It should be understood that thermal insulators act to prevent the exchange of thermal energy, and thus isolate the thermal energy that is present on either side of the insulator (e.g., to contain the reduced temperatures generated within the insulator encasing the $CO_2$ cylinder, and to isolate warmer temperatures that may reside on the opposite side of the insulator from being transferred to the cylinder). Similar thermal insulators are commonly used, for example, for encasing a cold beverage, where the insulator aids both in maintaining the beverage cold and in preventing the cold from reaching a user's hand while holding the insulated beverage. Thus, thermal insulators do not perform a heat transfer or exchange, but have been employed in some instances to contain the reduced temperatures generated by a $CO_2$ cylinder within an encasing insulator so not to cause frostbite or significant discomfort due to extreme cold when touching the cylinder.

The reduced temperature and potential freezing of $CO_2$-driven devices has traditionally been addressed in varying ways, depending on the intended application of the compressed gas-driven device. First, there are certain devices that are not expected to encounter extended use. For instance, in certain devices, the $CO_2$ is expended in an unregulated-flow, such as in an explosive-type expulsion. As an example, U.S. Pat. No. 5,149,290 titled "Confetti Canon" (hereinafter "the '290 patent") describes a device that employs an unregulated flow of $CO_2$ for projecting confetti. For instance, the '290 patent describes a confetti canon that has "a cartridge puncturing mechanism which enables complete discharge of $CO_2$ cartridge contents in less than three seconds," see the abstract of the '290 patent. Such unregulated flow devices may not encounter freezing due to the quick expulsion of the $CO_2$, rather than extended, regulated use thereof. Accordingly, in many such unregulated flow devices, measures are simply not taken for addressing the reduction in temperature and potential freezing that may occur through extended use of $CO_2$ driving the device.

Other devices exist which employ regulated $CO_2$ flow, but which do not address freezing. For instance, certain devices may be intended for such limited-time intermittent use that the freezing is not expected to become an issue. That is, the use of the $CO_2$ may be intended to be sufficiently intermittent that temperature reduction to an extent that interferes with operation of the device (e.g., freezing) is not expected to be encountered (e.g., sufficiently long recovery periods of non-operation are expected to be present in the intermittent use of certain devices).

As another example, other devices may be intended for extended use, but are implemented to simply accept the reduction in temperature and eventual freezing of the device. For instance, a $CO_2$-driven air chuck may be implemented for use in airing tires (as may be used for roadside emergencies or off-road application, for example), wherein the device does not attempt to counteract, in any way, the reduction in temperature and potential freezing encountered through use of the $CO_2$ but instead accepts that after a certain amount of extended use it will freeze (and the air chuck will cease to operate while frozen).

Certain $CO_2$ devices may be implemented with a piston-driven regulator for regulating the output flow of $CO_2$ from the storage cylinder. Examples of such piston-driven regulators that may be implemented include those disclosed in U.S. Pat. No. 5,411,053 titled "Fluid Pressure Regulator" and U.S. Pat. No. 5,522,421 titled "Fluid Pressure Regulator", the disclosures of which are hereby incorporated herein by reference. Further examples of piston-driven regulators that be implemented include those commercially known as HyperFlo, HyperFlo2, HyperFloMAX, HyperFloDYN COMPACT available from Offroad Tuff (see e.g., http://www.offroadtuff.com/CO2Regulators.htm). Certain piston-driven regulators are marketed as being "no freeze." However, such no-freeze regulators themselves do not prevent or counteract freezing from occurring in the $CO_2$ storage cylinder, and over extended, substantially continuous use in dispensing $CO_2$, the no-freeze regulators themselves have been found to eventually freeze if further counteracting measures are not employed.

Certain regulated-flow $CO_2$-driven devices permit extended use and attempt to address reduced temperatures and potential freezing through persistently-maintained, active application of heat to the $CO_2$ storage cylinder and/or other device components. One traditional approach for counteracting the reduced temperatures resulting from substantially continuous use of the regulated-flow, extended-use $CO_2$-driven devices is to implement electrically-powered heater(s) for actively heating the cylinder and/or other components of the device. Such electrically-powered heater(s) provide a persistently-maintained heat source that can persist in actively generating heat for heating the cylinder over periods of extended use.

As one example, the Biomist™ Power Sanitizing System commercially available from Biomist, Inc. (see www.biomistinc.com) is a $CO_2$-driven sanitizing device that employs on-board electrically-powered (i.e., AC-powered) heaters. The Biomist™ Power Sanitizing System employs a siphon-type $CO_2$ cylinder, which discharges liquid $CO_2$. The on-board electrically-powered heaters are used to heat the discharged liquid to convert it to gas, and the gas is then used as a propellant for outputting (e.g., via a spray nozzle) a sanitizing solution. Without the electrically-powered heaters, the desired conversion of liquid $CO_2$ to gas for use as a propellant would not be achieved in the Biomist™ Power Sanitizing System, and eventual freezing of the $CO_2$ cylinder and/or regulator (or other device components) would be encountered after a period of extended, substantially-continuous use so as to interfere with operation of the sanitizing device.

As another example, U.S. Pat. No. 6,043,287 (hereafter "the '287 patent") titled "Disinfectant Composition and a Disinfection Method Using the Same," the disclosure of which is hereby incorporated herein by reference, discloses "a disinfectant composition which is suited to the disinfection of confined spaces such as the interior of an ambulance or the like", see abstract of the '287 patent. The '287 patent further proposes "atomizing and spraying this disinfectant composition by means of a high-pressure gas such as pressurized carbon dioxide gas". Id. As illustrated in FIG. 1 of the '287 patent and discussed therein (e.g., at column 4, lines 18-29), the '287 patent proposes use of a siphon-type $CO_2$ cylinder with an AC-powered heater. Thus, as with the Biomist™ Power Sanitizing System, the '287 patent proposes a system that relies on electrically-powered heaters for achieving the desired conversion of liquid $CO_2$ to gas for use as a propellant, and without such electrically-powered heaters eventual freezing of the $CO_2$ cylinder and/or regulator (or other device components) would be encountered after a period of extended, substantially-continuous use so as to interfere with operation of the sanitizing device.

As another example U.S. Pat. No. 6,025,576 (hereafter "the 576 patent") titled "Bulk Vessel Heater Skid For Liquefied Compressed Gases" describes generally "heating a container that stores and dispenses compressed gas and, specifically, with a heater arrangement attached to a skid for heating bulk vessels that store and dispense liquefied compressed gas", see column 1, lines 5-8 of the '576 patent. In the '576 patent a "heater skid comprises a framework for receiving the cylinder and one or more heaters coupled to the framework so that the received cylinder is proximate to the heaters, thus, allowing the heaters to heat the cylinder", see abstract of the '576 patent.

Another example of a heating technique that has been proposed for use in gas delivery systems is an active heating/cooling jacket which is placed in intimate contact with the gas cylinder and the jacket is maintained at a constant temperature by a circulating fluid, the temperature of which is actively controlled by an external heater/chiller unit. As examples, U.S. Pat. No. 6,076,359 (hereafter "the '359 patent") titled "System and Method for Controlled Delivery of Liquified Gases" and U.S. Pat. No. 6,581,412 (hereafter "the '412 patent") titled "Gas Delivery at High Flow Rates," the disclosures of which are hereby incorporated herein by reference, each mention use of such an active heating/cooling jacket and/or other techniques for actively heating/cooling gas cylinders, particularly for use in controlled delivery of gas in semiconductor processing.

The '359 patent mentions in its background use of heating/cooling jackets (see column 2 line 59-column 4, line 27 thereof). The jacket is described as being placed in intimate contact with the cylinder and the jacket is maintained at a constant temperature by a circulating fluid, the temperature of which is controlled by an external heater/chiller unit. Thus, some persistently-maintained (e.g., electrically-powered) heater/chiller unit is employed for actively, persistently maintaining the temperature of the jacket at a constant temperature. The '359 patent further describes the use of such a jacket as being problematic for several reasons, and thus proposes a solution that avoids the use of the jacket altogether. In particular, the '359 patent proposes a system that increases the heat transfer between the ambient and the gas cylinder placed in a gas cabinet. The increase is achieved by altering air flow rate in the cabinet and adding fins internal to the cabinet. For instance, at column 9, line 37-column 10, line 37 (and see FIGS. 10-11 of the '359 patent), the '359 patent describes that air may be pulled into the cabinet containing the gas cylinder, and the air may be actively heated with an electrically-powered heating element, such as a hot plate-type heater. The circulating air passing through the cabinet is used to heat the gas cylinder. This is described as enhancing the heat transfer from the ambient to the cylinder.

The '412 patent also appears to propose use of a persistently-maintained, active heating means, such as an electrically-powered heater, for heating a jacket or hot fluid that is in direct contact with the gas cylinder, see e.g., column 4, line 48-column 5, line 35 thereof and see the heaters shown in FIG. 7, which are electrically powered as mentioned in column 10, lines 8-12 of the '412 patent.

U.S. Pat. No. 5,986,240 (hereafter "the '240 patent") titled "Method and Apparatus for Maintaining Contents of a Compressed Gas Cylinder at a Desired Temperature," mentions in its background (see column 1, lines 35-52 thereof) that a heating blanket may be wrapped around a cylinder to heat the cylinder. However, the '240 patent describes that the use of such a blanket is not desirable (see column 1, lines 35-48 thereof), and thus goes on to propose use of a persistently-maintained heat source, such as electrically-powered heaters, as mentioned at column 3, lines 2-5 and shown as element 15 in its FIG. 3, for warming the air around the gas cylinder within the cabinet.

As yet another example, U.S. Pat. No. 4,627,822 (hereafter "the '822 patent") titled "Low Temperature Inflator Apparatus" proposes another type of active heater for heating a $CO_2$ cylinder. The '822 patent proposes use of a non-persistently maintainable heat source for heating a $CO_2$ cylinder. In particular, the '822 patent proposes an inflator assembly (see assembly 10 of FIG. 1 of the '822 patent) for inflating an inflatable life raft or life preserver, where the inflator assembly includes a $CO_2$ cylinder (see $CO_2$ cylinder 15 in FIG. 1 of the '822 patent) for driving inflation of the life raft or preserver. The inflator assembly further includes an on-board solid pyrotechnic gas generator (see generator 16 in FIG. 1 of the '822 patent) that is positioned side-by-side the $CO_2$ cylinder. The '822 patent employs a heat conductive material (see material 19 in FIG. 1 and core 46 and winding 47 of FIG. 3 of the '822 patent), such as aluminum, which conducts heat from the solid pyrotechnic gas generator to the $CO_2$ cylinder, see column 2, lines 25-30 and column 3, lines 8-15. In operation, an actuator punctures the cartridge and ignites the generator, and combustion gas from the generator will begin immediate inflation of the inflatable gear, while heat developed by the generator is transferred to the liquid CO2 for accelerating the venting of high pressure CO2 gas to the gear, see column 1, lines 60-66.

As still another example, U.S. Patent Application Publication No 2004/0050877 (hereafter "the '877 application") titled "Sterilizing and Disinfecting Apparatus," the disclosure of which is hereby incorporated herein by reference, proposes "an apparatus for sterilizing and disinfecting a target space by spraying a chemical including alcohol", see abstract of the '877 application. The proposed apparatus is driven by a compressed gas, such as $CO_2$, that acts as a propellant for dispensing the sterilizing and disinfecting solution. The '887 application describes in its background (see paragraphs 0003-0011 thereof) that traditional such compressed gas-driven sterilizing and disinfecting devices have included electrically-powered heaters. The '887 application proposes a sterilizing and disinfecting apparatus that can "operate with a simple structure requiring no power supply", see abstract of the '877 application. However, the '887 application recognizes in paragraph 0043 that in "the process of injecting the carrier gas . . . , there is a possibility that volume expansion due to decompression in the pressure reducing valve 2 causes the peripheral part to freeze," but the '877 application explains that "it is possible to delay the time to freeze by appropriately determining the feed rate of the carrier gas." Thus, the '877 application does not propose any technique for counteracting the reduced temperature generated by the operation of the compressed gas (e.g., $CO_2$) in driving its apparatus (e.g., acting as a propellant), but instead accepts that freezing may eventually occur, and merely proposes to attempt to delay the occurrence of the freezing through controlling feed rate of the carrier gas.

One particular example of a compressed gas-driven device is a solution dispensing device (e.g., a sprayer, mister, etc.) which employs compressed liquefied gas (e.g., $CO_2$) as a propellant for dispensing (e.g., spraying, misting, etc.) a target solution, such as a sanitizing solution (e.g., a disinfecting and/or sterilizing solution, such as the above-mentioned alcohol-based solutions of the '287 patent and the '877 application), a beverage, a pesticide solution, etc. In many applications of such a device, extended use may be desired which, if not counteracted, may lead to undesirable freezing of the $CO_2$ cylinder and/or components of the device. As in the above-referenced '287 patent, electrically-powered heaters have commonly been proposed for use in persistently generating heat for actively heating the $CO_2$ cylinder and/or components of the device (e.g., to maintain a constant temperature thereof). In some instances, such as in the above-referenced '359 and '412 patents, the heater may actively heat a jacket that is in intimate contact with the cylinder, for example.

However, the implementation of electrically-powered heaters leads to increased weight, size, and cost of the device, and the use of electrically-powered heaters presents potential hazards that render the implementation unsuitable or undesirable for use in many environments in which electrical sparks may present a fire hazard. For instance, pet food production plants, grain silos, or other industrial environments may prohibit use of any electrical outlet or any electrically-powered devices due to the risk of sparking the airborne dust present in the facility. Similarly, other potential ignition sources, such as the pyrotechnic gas generator of the '822 patent, may be unsuitable for many environments because of the potential fire hazard.

Further, the AC powered solution, such as in the '287 patent, limits mobility of the device during operation (e.g., due to being tethered via an electrical cord to an electrical outlet), and it restricts use of the device to locations that have readily-accessible electrical outlets. On-board batteries may be implemented to alleviate the tethering effect of the AC power cord, but this further increases the size and weight of the device (due to the batteries), and still presents a potential electrical spark hazard.

BRIEF SUMMARY

The present invention is directed generally to a system and method which employ a compressed gas-driven device with a passive thermodynamic composition. Certain embodiments provide a compressed gas-driven (e.g., $CO_2$-driven) device implementation that includes a passive thermodynamic composition which allows for extended use of the device without freezing and without requiring a persistently-maintained, active (e.g., electrically-powered) heating. Further, certain embodiments provide a compressed gas-driven (e.g., $CO_2$-driven) device implementation that includes a passive thermodynamic composition which allows for extended use of the device without freezing and without requiring an ignition heat source (e.g., electrically-powered or pyrotechnic as generator) for heating the device.

For instance, the thermodynamic composition may be implemented within an encasing (e.g., sleeve) that maintains the composition in thermal communication with (e.g., in intimate contact with) the compressed gas cylinder for performing a thermal transfer/exchange with the cylinder. The thermodynamic composition may be implemented within an enclosing container, such as within a sealed plastic bag or other non-insulating container via which thermal communication can occur. Thus, such a non-insulating enclosing container that contains the thermodynamic composition may be arranged in a cavity within an encasing (e.g., sleeve) in which the cylinder is disposed, wherein the non-insulating container containing the thermodynamic composition may be disposed to be in thermal communication with the cylinder. In other embodiments, the thermodynamic composition may be a solution that is filled in such a cavity within the encasing (e.g., sleeve) and which is held in direct contact with the cylinder disposed in the encasing (rather than being contained in a non-insulating container that is arranged in thermal communication with the cylinder). In either implementation, the thermodynamic composition is considered herein as being in thermal communication with the cylinder (e.g., via intimate contact either directly with the cylinder or through a non-insulating container). In certain embodiments, the thermodynamic composition may additionally be implemented to be in thermal communication (e.g., via intimate contact) with other components of the compressed gas-driven device, such as a regulator, hose, etc., to aid in counteracting potential freezing that may occur at those portions of the device as well. In certain embodiments, the casing (e.g., sleeve) in which the compressed gas cylinder and thermodynamic composition are disposed may further include a regulator, such as a piston-driven regulator, that is communicatively coupled with the cylinder for regulating the flow of gas from the cylinder.

The thermodynamic composition, according to certain embodiments, performs a bi-directional thermal exchange with the $CO_2$ cylinder. That is, the thermodynamic composition absorbs cold that is generated by the $CO_2$ cylinder and thus removes the cold from the $CO_2$ cylinder, until the thermodynamic composition, itself freezes. In addition to absorbing the cold from the $CO_2$ cylinder, the thermodynamic composition provides heat to the $CO_2$ cylinder, until the thermodynamic composition itself freezes. In one embodiment, the thermodynamic composition presents a constant (e.g., 59 degree Fahrenheit) temperature of warmth, until the composition itself freezes. As discussed further herein, in certain embodiments, use of the thermodynamic composition enables extended use of the $CO_2$ cylinder without encountering freezing, and without requiring an active heat source to be implemented for the $CO_2$-driven device, such as an ignition heat source (e.g., a electrically-powered or pyrotechnic heat source).

As described further herein, a passive thermodynamic composition is implemented. As used herein, the "passive" thermodynamic composition refers generally to a thermodynamic composition that does not require a persistently maintainable, active heat source for heating the thermodynamic composition, such as an electrically-powered heat source. An "active" heat source, as used herein, refers generally to a heat source that is implemented expressly for generating heat to be directed to any component of the compressed gas-driven device, including a thermodynamic composition, cylinder, lines (e.g., hoses), regulator, etc. Examples of such active heat sources include electrically-powered heat sources for generating heat (which may be persistently maintained), pyrotechnic gas generator, and chemically-reactive heat generators that generate heat (which may be non-persistent) resulting from the occurrence of a chemical reaction. Certain active heat sources are igniting heat sources, such as electrically-powered and pyrotechnic-based heat sources, which may potentially present risk of sparks and/or fire hazards.

The compressed gas-powered device may, for example, be used in an environment having an ambient temperature, wherein the ambient temperature of the environment may be affected by various heat generation sources that are external to the compressed gas-powered device, such as the sun, body heat from persons in and around the environment, machinery and/or other devices in and around the environment, and/or an air conditioning system (e.g., an electrically-powered air conditioning system) for heating the environment (e.g., a building). Accordingly, an "active" heat source, as referred to herein, refers to a heat source that is included in the compressed gas-powered device for the express purpose of generating heat beyond that in the ambient environment for heating any component of the compressed gas-driven device. Such an active heat source has been conventionally employed for heating the air within a cabinet in which the device components (e.g., cylinder) resides or otherwise expressly generating heat for heating the device components, as examples. Embodiments of the present invention may be deployed in an environment that may have an ambient temperature resulting from heating by certain extraneous heat sources, such as those mentioned above (e.g., the sun, body heat, devices in the environment, and/or an air conditioning system). However, embodiments of the present invention are not reliant on any such ambient temperature. Moreover, embodiments of the present invention do not require any active heat source to be employed expressly for heating any of the compressed gas-driven device components, including without limitation the thermodynamic composition or cylinder. Thus, according to certain embodiments, the performance of the passive thermodynamic composition that is employed for counteracting cold generated by the cylinder is not reliant on external heating, whether by the ambient temperature of the environment or by any active heat source.

As discussed further herein, embodiments of the present invention include a passive thermodynamic composition to enable a $CO_2$-driven device to be implemented and employed with substantially-continuous use over an extended period of time without requiring any active heat source to be implemented for the device. In certain embodiments, an active heat source may be added to further supplement the passive thermodynamic composition. For instance, an ignition-passive heat source, such as a non-persistent chemically-reactive heat source that generates heat through a chemical reaction, may be included to supplement the passive thermodynamic composition (e.g., to aid in warming the cylinder and/or the passive thermodynamic composition). However, such a supplemental active heat source is not required for many extended-use applications, and thus may be omitted in many embodiments. Because the thermodynamic composition is passive, it will eventually freeze and thus cease being able to perform a sufficient thermal exchange to counteract freezing of the $CO_2$ cylinder, after a certain period of substantially-continuous extended use (even if supplemented by a non-persistent active heat source that generates heat that eventually dissipates). As discussed further herein, a ratio of a volume of the thermodynamic composition that is implemented in relation to a size of the $CO_2$ cylinder that is employed may be selected so as to permit a desired amount of substantially-continuous extended use without freezing. For instance, a ratio of a volume of the thermodynamic composition that is implemented in relation to a size of the $CO_2$ cylinder that is employed may be selected so as to permit a full cylinder of such size to be completely discharged in a regulated flow over substantially-continuous extended use without freezing.

Thus, the passive thermodynamic composition according to embodiments of the present invention is not circulated through an electrically-powered heater/chiller to persistently maintain its temperature constant, as with the jackets mentioned in the above-referenced '359 and '412 patents. Further, the passive thermodynamic composition need not be heated by any active heat source, such as an ignition heat source (e.g., an electrically-powered or pyrotechnic-based heat source). In some instances, the passive thermodynamic composition is fully passive in that it is not actively heated by any heat source that is implemented expressly for heating the composition, but rather the thermodynamic composition may be implemented within an ambient environment and perform a thermal exchange with the compressed gas cylinder.

As mentioned above, in certain embodiments, the compressed gas-driven device may include an active heat generator for supplementing the passive thermodynamic composition, wherein the passive thermodynamic composition may be in thermal communication with an active heat generator, such as a non-persistent, active heat generator. One example of a non-persistent, active heat generator is the pyrotechnic gas generator of the '822 patent. However, such pyrotechnic gas generator is an ignition-based heat source, which may be unacceptable for many environments that are fire-risk averse. Another example of a non-persistent, active heat generator is a heat generator that generates heat resulting from a chemical-reaction (e.g., as in conventional hand warmers), which is not persistently maintainable (as with an electrically-powered heat source) but instead may generate heat that will dissipate over time.

In either the fully passive implementation or the implementation with a supplemental non-persistent, active heat generator, an electrically-powered or other ignition-based heat source for actively warming the thermodynamic composition or the cylinder is not required, as is required in the jackets of the above-mentioned '359 and '412 patents and as is required in the above-mentioned Biomist™ Power Sanitizing System and the '240, '287, '576, and '822 patents. Also, the passive thermodynamic composition of embodiments of the present invention is not a mere heat conductive material for conducting heat from an active heat source, such as the aluminum heat transfer material implemented in the '822 patent for conducting heat from a pyrotechnic gas generator to a $CO_2$ cylinder. Instead, the passive thermodynamic composition of certain embodiments is employed to perform a thermal exchange with the $CO_2$ cylinder for absorbing cold that is generated by the cylinder and to present the cylinder with a warmer (e.g., 59 degree Fahrenheit) temperature, until if and when the composition itself freezes.

In one embodiment of the present invention, the compressed gas-driven device is a $CO_2$-driven sanitizing device, where the $CO_2$ is employed as a propellant for spraying (e.g., misting) a sanitizing solution, and wherein the sanitizing device does not require an electrically-powered heating element, while permitting extended use thereof without freezing resulting from the extended use of the $CO_2$. As used herein, "sanitizing" refers generally to any solution for sanitizing, disinfecting, sterilizing, and/or for acting as, but not limited to, a fungicidal, antimicrobial, antibacterial, sporicidal, viricidal, tuberculocidal and/or salmonellacidal. In certain embodiments, the permitted extended use of the device is substantially-continuous use of at least one full $CO_2$ cylinder. That is, a full $CO_2$ cylinder may be used substantially continuously to fully empty the cylinder, without freezing of the $CO_2$ cylinder and/or other device components by the reduced temperatures resulting, from the $CO_2$ usage. The extended, substantially continuous use may be uninterrupted use or intermittent use with sufficiently small delays between uses over a period of time that would otherwise lead to freezing of the $CO_2$ cylinder and/or other device components if the reduced temperatures resulting from the $CO_2$ usage are not counteracted.

In certain embodiments, after substantially-continuous use of a full $CO_2$ cylinder, some "recovery period" may be needed to enable the passive thermodynamic composition to reheat before substantially continuous use of a next $CO_2$ cylinder may be fully supported without potentially encountering freezing. Of course, in certain embodiments, the thermodynamic composition (e.g., sleeve or encasing) may be replaced when refilling or replacing a $CO_2$ cylinder so as to permit continued use without freezing from one cylinder to the next, and/or a greater ratio of thermodynamic composition to cylinder size may be employed to potentially support longer substantially continuous use, which may enable a given thermodynamic encasing to counteract the reduced temperatures resulting from substantially-continuous use of multiple cylinders in succession without encountering freezing. As used herein, a period of time for completely emptying a full compressed gas cylinder through substantially continuous use of the compressed gas-driven device may be referred to as a "full cylinder use cycle".

It should be recognized that the above-mentioned "recovery period" may not be disruptive beyond the use of $CO_2$ cylinders in many conventional applications. For instance, in many applications, down-time (i.e., period of non-use) of a given $CO_2$ cylinder is generally encountered once the given $CO_2$ cylinder is emptied. Such down-time is commonly encountered, for instance, while the $CO_2$ cylinder is refilled, which often involves transporting the cylinder to a refill location. While the emptied $CO_2$ cylinder is being refilled, a standby, replacement $CO_2$ cylinder (e.g., that is a full cylinder) may be implemented within the $CO_2$-driven device to enable continued use thereof. Similarly, in accordance with embodiments of the present invention, once a given $CO_2$ cylinder is emptied, the $CO_2$ power assembly (e.g., an encasing that includes the $CO_2$ cylinder and the passive thermodynamic composition that is in thermal communication with the $CO_2$ cylinder, and in certain embodiments may also include the piston-driven regulator) may be handled for refilling the $CO_2$ cylinder, and during such conventional refilling (e.g., which may include transporting the $CO_2$ cylinder to a refill location) a sufficient recovery period generally lapses for the passive thermodynamic composition that is in thermal communication with the $CO_2$ cylinder being refilled. In the meantime, while the emptied $CO_2$ cylinder of a first $CO_2$ power assembly is being refilled, a standby, replacement $CO_2$ power assembly (e.g., that includes a full $CO_2$ cylinder and corresponding passive thermodynamic composition in thermal communication therewith, and in certain embodiments a piston-driven regulator) may be implemented within the $CO_2$-driven device to enable continued use thereof. In certain embodiments, the $CO_2$ power assembly may include the $CO_2$ cylinder and thermodynamic composition therein, and may further include a piston-driven regulator that is communicatively coupled with the cylinder for regulating the flow of gas from the cylinder. In certain embodiments, the casing may have a hinged door or other mechanism that selectively permits access to the interior of the casing, which may be opened to permit a user to selectively refill or replace (or otherwise perform maintenance) on one or more of the cylinder, thermodynamic composition, and regulator contained therein.

In one exemplary embodiment, the $CO_2$-driven device includes a $CO_2$ cylinder. The device may be implemented using either a standard type or siphon type cylinder, as examples. In a preferred embodiment, a standard type cylinder is employed. With a siphon type cylinder, active heating may be required for actively heating the discharged liquid $CO_2$ to convert it to gas. However, with the standard type cylinder, no such active heating is required because the gas conversion is performed within the $CO_2$ cylinder and the CO2 cylinder dispenses gas. The cylinder may, in certain embodiments, be implemented within a portable housing, such as within a backpack, shoulder-strap, or other user-wearable, carryable, or transportable housing.

The device further includes a regulator for regulating the flow of the $CO_2$ from the cylinder. In certain embodiments, the regulator is a piston-driven regulator. In a preferred embodiment, a compensating piston-driven regulator is employed. Examples of piston-driven regulators and/or compensating piston-driven regulators which may be employed include those disclosed in U.S. Pat. No. 5,411,053 titled "Fluid Pressure Regulator" and U.S. Pat. No. 5,522,421 titled "Fluid Pressure Regulator", the disclosures of which are hereby incorporated herein by reference, the regulators commercially known as HyperFlo, HyperFlo2, HyperFloMAX, HyperFloDYN COMPACT available from Offroad Tuff (see e.g., http://www.offroadtuff.com/CO2Regulators.htm), and the regulators commercially available from REHVAC™ (see www.rehvacmfg.com) such as the CT-475, RT-140, GT-750, CT-475M, GT-500 regulators. REHVAC also provides a Series 3000 model compensating piston-driven regulator that may be employed in a preferred embodiment. A compensating piston-driven regulator allows for a continuous output of pressure. As the $CO_2$ is being expelled from the cylinder, its temperature drops, which may result in a needed change in the amount of pressure that the regulator allows. In a non-compensating piston-driven regulator, a user may manually adjust the flow in order to maintain a constant PSI (pound per square inch), whereas a compensating piston-driven regulator automatically adjusts for the change in temperature of the tank so as to provide a constant flow without requiring manual intervention by the user. Either a compensating or a non-compensating piston-driven regulator may be employed in accordance with embodiments of the present invention, but a compensating piston-driven regulator may be preferred for convenience of the user.

Further, the device includes a passive thermodynamic composition that performs a thermal transfer/exchange for counteracting the reduced temperature resulting from the expulsion of the $CO_2$ gas from the cylinder. In one embodiment, the thermodynamic composition is implemented in intimate contact with at least the $CO_2$ cylinder (e.g., as a sleeve or other encasing about all or a portion of the $CO_2$ cylinder). Any suitable thermodynamic composition for performing a thermal exchange may be implemented. In certain embodiments, the thermodynamic composition performs a bidirectional thermal exchange with the cylinder, wherein it extracts cold from the $CO_2$ cylinder and transfers the cold away from the $CO_2$ cylinder, and it provides heat to the cylinder (e.g., at a relatively constant 59 degree Fahrenheit temperature), until if and when the composition itself freezes. The passive thermodynamic composition may, as one example, be water. Preferably, the passive thermodynamic composition is a composition that has a higher melting point than that of water, such as a composition of water and sodium carboxymethyl cellulose. An exemplary preferred passive thermodynamic composition that is employed in certain embodiments has approximately 98% water and approximately 2% sodium carboxymethyl cellulose.

In certain embodiments, the $CO_2$-driven device is a sanitizing device, where the $CO_2$ is employed as a propellant for spraying (e.g., misting) a sanitizing solution, and wherein the sanitizing device does not require an active (e.g., electrically-powered heating element), awhile permitting extended use thereof without freezing resulting from the extended use of the $CO_2$. In certain embodiments, the sanitizing solution may be a flammable solution, such as an alcohol-based solution, where the $CO_2$ propellant serves as a flame retardant. For instance, $CO_2$ will not burn or support combustion. Air with $CO_2$ content of more than 10% will extinguish an open flame. Thus, $CO_2$ is used as an inert gas in many chemical processes, in the storage of carbon powder, and in fire extinguishers, as examples. Cold sterilization can be carried out with a mixture of 90% $CO_2$ and 10% ethylene oxide, as an example, where the $CO_2$ has a stabilizing effect on the ethylene oxide and reduces the risk of explosion. In this way, the desirable sanitizing properties of a flammable (e.g., alcohol-based) solution may be employed without the heightened risk of fire due to the flame retardant properties of the $CO_2$ propellant. As examples, the sanitizing solution may, in certain embodiments, be a solution such as those disclosed in the '287 patent or in the '877 application.

As a further example, the sanitizing solution may, in certain embodiments, be the Biomist™ Formula D2 sanitizer, which is registered (Registration Number 73232-1-81599) by the U.S. Environmental Protection Agency as an effective sanitizer, disinfectant, viricidal and tuberculocidal solution and is compliant with the Federal Insecticide, Fungicide and Rodenticide Act (FIFRA). The Biomist Fomula D2 sanitizer contains a solution of alcohol and a quaternary ammonium (quat) compound to continue the sanitizing action even after the alcohol has completed its killing function and evaporated. Such an Alcohol/Quat-based solution is becoming a widely accepted disinfectant product again on the market today due to its non-corrosiveness and non-toxicity and its improved fire safety when used in combination with $CO_2$. They also kill a wide range of pathogens and do not typically contain any staining or corrosive characteristics. They are fairly inexpensive, and do not present any serious health hazards. They tend to contain an odor, although it usually dissipates rather quickly.

Other sanitizing solutions may be used in certain embodiments, including as examples Glutaraldehyde-based solutions, Phenol-based solutions, Iodophore-based solutions, Bleach-based solutions, and Quaternary Amonium-based solutions, each of which are briefly discussed hereafter. Glutaraldehyde-based solutions are generally inexpensive and are not known to stain or corrode surfaces to which they are applied, and are typically meant to be used as cold sterilants. Phenol-based solutions generally do not have much of an odor and do not stain or corrode the surfaces to which they are applied, but they have been found to be extremely toxic, often causing sinus and respiratory problems, as well as headaches and nausea due to overexposure and/or lack of proper ventilation. Iodophore-based solutions are generally low odor, non-corrosive, and inexpensive, but they generally lack speed of kill and their dilution and contact times are too critical for their efficacy to be consistent and practical in many settings. Bleach-based solutions are well-known for their killing power, speed, and safety, but they tend to be extremely corrosive and damaging to surfaces and usually contain a heavy odor. Quaternary Amonium-based solutions are a commonly-used type of hard-surface disinfectant, which have been found to be very effective and safe. However, they are generally not very fast acting (e.g., typically 10 minute kill time), and present potential for staining and residue to be left behind, depending on the amount of quat in the given solution's formulation.

In certain embodiments a $CO_2$-driven sanitizing device may be implemented similar to the devices described in the '287 patent or the '877 application, e.g., employing similar $CO_2$ cylinders and/or sanitizing solutions. For instance, the device of the '287 patent may be adapted in accordance with an embodiment of the present invention so as to eliminate the need for its electrically-powered heaters. For example, the device of the '287 patent may be modified in accordance with one embodiment of the present invention to implement a standard $CO_2$ cylinder with a passive thermodynamic composition and a piston-driven regulator (e.g., compensating piston-driven regulator) as described further herein, and thus eliminate the electrically-powered heaters required by the '287 patent. This results in a much more flexible-use device, which may be smaller, lighter, more portable, and may be utilized without the requirement of tethering to an AC power outlet or implementing batteries for powering electrical heaters. In certain embodiments, no electrical power (or other ignition source) is required for the device, and thus all risk of electrical spark (which is a concern in many industrial environments) associated with use of the device may be eliminated.

As another example, the device of the '877 application may be adapted in accordance with an embodiment of the present invention so as to permit extended use without concern for freezing due to the reduced temperatures resulting from expulsion of the $CO_2$ from the cylinder. For example, the device of the '877 application may be modified in accordance with one embodiment of the present invention to implement the passive thermal composition and piston-driven regulator (e.g., compensating piston-driven regulator) described herein so as to result in extended use of the device without freezing resulting from reduced temperatures generated by the expulsion of $CO_2$ from the cylinder.

In other embodiments, the $CO_2$-driven device may employ $CO_2$ as a propellant for solutions other than sanitizing solutions. Further, in other embodiments, the $CO_2$-driven device may comprise a pneumatic tool or other device that is powered by the $CO_2$. Thus, instead of serving as a propellant, in certain embodiments, the $CO_2$ output is used for powering (or "driving") another device, such as a pneumatic tool. Again, the implementation of the passive thermodynamic composition permits extended, substantially continuous use of the $CO_2$-driven device without operation of the device being interrupted as a result of freezing caused by the expulsion of the $CO_2$ from the cylinder. While $CO_2$ is mentioned as the compressed gas that is the driving source utilized in many embodiments, it should be understood that other liquefied compressed gases, such as nitrogen, may be employed instead in alternative embodiments. As an example, in certain embodiments, other liquefied compressed gases, such as any of those mentioned in the '240 patent, the '287 patent, the '359 patent, the '412 and/or the '877 application may be used in the cylinder, depending on the desired use/application and/or environment. In a preferred embodiment, $CO_2$ is employed because of its constant pressure characteristics mentioned above.

In certain embodiments, the thermodynamic composition is implemented in an electrically-passive manner, wherein electrical power is not required for actively generating a persistently-maintained heat for heating the thermodynamic composition. Indeed, in accordance with certain embodiments, no persistently-maintained heat source (such as an electrically-powered heat source) is required to be implemented for actively heating the gas cylinder or the thermodynamic composition during operation of the device. Of course, in certain embodiments, while the device is electrically passive, a thermally-active composition may be included in the device for supplementing the passive thermodynamic composition by heating the passive thermodynamic composition, the cylinder, and/or other device components through, for example, a chemical reaction that produces heat that is transferred to the thermodynamic composition, cylinder, and/or other components. For instance, an exothermic chemical reaction may occur in a thermally-active composition. An example of such a thermally-active composition that may be employed is one such as those commonly employed in hand warmers for producing heat on demand to warm cold hands. Depending on the type and the source of heat, hand warmers last between 30 minutes (recrystallisation) to 12-24 hours (platinum catalyst). Some hand warmers contain cellulose, iron, water, activated carbon, vermiculite and salt and produce heat from the exothermic oxidation of iron when exposed to air. In a similar manner, in certain embodiments, a thermally-active composition may be implemented to perform such an exothermic oxidation of iron when exposed to air to generate heat to be transferred to the thermodynamic composition.

Another type of hand warmers generate heat through exothermic crystallisation of supersaturated solutions and are usually reusable. These can be recharged by boiling the warmers and allowing them to cool. Heating of these pads is triggered by snapping a small metal device buried in the pad which generates nucleation centers which initiate crystallisation. Heat is required to dissolve the salt in its own water of crystallisation and it is this heat that is released when crystallisation is initiated. In a similar manner, in certain embodiments, a thermally-active composition may be implemented to perform such a crystallisation that releases heat to be transferred to the thermodynamic composition.

In each of the above examples, the device remains electrically passive (i.e., does not require electrical power). Further, a persistently-maintained active heat source for generating heat (such as an electrically-powered heat source) is not required. Instead, a non-persistent active heat source (which may be referred to as a relenting or yielding active heat source), such as a heat source that generates heat resulting from performance of a chemical reaction, which will eventually dissipate, may be implemented in certain embodiments. Such a non-persistently-maintained heat source may, in certain embodiments, be included to actively heating any component of the device, such as the cylinder, thermodynamic composition, hoses, regulator, etc. Such an active heat source may be particularly desirable for heating the hoses and/or regulator in a device that implements a siphon-type cylinder, for example, in order to heat the discharged liquid $CO_2$ to generate the conversion to gas (or vapor) $CO_2$. Thus, in either case, an electrically-powered heat source is not required for heating any component of the compressed gas-drive device (e.g., cylinder), which alleviates the increased size, weight, cost, and potential spark hazards attendant with such electrically-powered heat sources. Further, an ignition-based heat source (e.g., a pyrotechnic-based heat source) is not required, which further enables an implementation with reduced fire hazard.

Again, in certain embodiments, no active heat generator is required for a desired extended use to be achieved (e.g., for a "full cylinder use cycle" to be achieved) without interruption of the device operation caused by freezing attributable to the $CO_2$. However, a supplemental active heat generator, such as those mentioned above, may be implemented in certain embodiments, if so desired, which may supplement the passive thermodynamic composition and/or which may aid in reducing a "recovery period" of the passive thermodynamic composition (e.g., for thawing the passive thermodynamic composition between full cylinder use cycles).

Thus, according to one embodiment, a compressed gas-driven device comprises a cylinder storing compressed gas, such as liquefied $CO_2$, and a target device that is driven by output from the cylinder, such as a solution dispensing interface (e.g., spray nozzle), pneumatic tool, etc. The compressed gas-drive device, according to one embodiment, further comprises a passive thermodynamic composition in thermal communication with the cylinder, wherein the thermodynamic composition performs a thermal exchange with the cylinder to enable substantially-continuous driving of the device by output from the cylinder for at least a full cylinder use cycle without the cylinder freezing and without requiring a persistent, actively generated heat source for heating the cylinder or the thermodynamic composition.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

Figure 1:
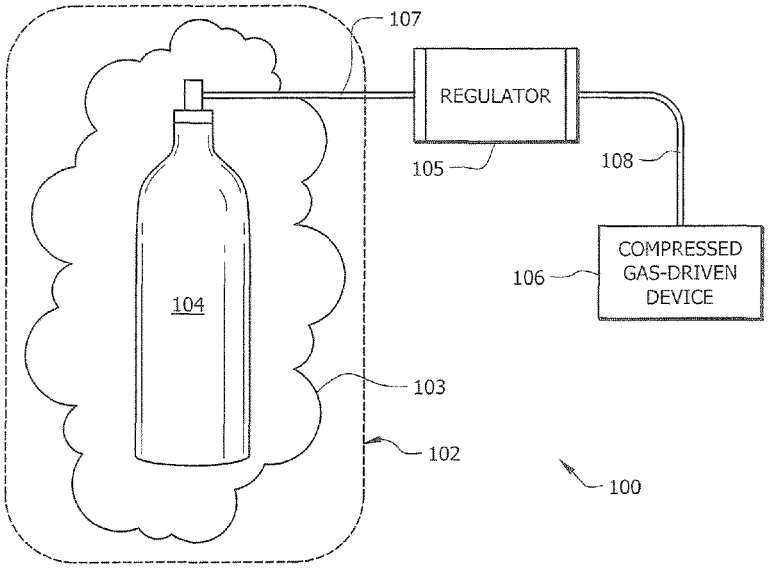
FIG. 1 shows a block diagram representation of an exemplary compressed gas-driven device implemented in accordance with one embodiment of the present invention.

FIG. 1 shows a block diagram representation of an exemplary compressed gas-driven device 100 implemented in accordance with one embodiment of the present invention. The device 100 comprises a compressed gas power assembly 102 that includes a compressed gas cylinder 104 that contains liquefied compressed gas, which in this example is $CO_2$. Of course, in other embodiments, the liquefied compressed gas utilized may be any other suitable gas appropriate for a given application, such as nitrogen or other inert gas, for example. In this example, cylinder 104 is implemented as a standard type cylinder. Assembly 102 further contains a passive thermodynamic composition 103 that is implemented in intimate contact with the cylinder 104. Thermodynamic composition 103 may be implemented within a sleeve, jacket, or other encasing about all or a portion of cylinder 104, which holds the passive thermodynamic composition 103 in a suitable positional relationship with respect to cylinder 104 to permit a thermal exchange to occur between the cylinder 104 and passive thermodynamic composition 103.

Any suitable passive thermodynamic composition for performing a thermal exchange may be implemented as composition 103. In certain embodiments, the passive thermodynamic composition 103 performs a bi-directional thermal exchange with the $CO_2$ cylinder. For instance, in certain embodiments, in addition to absorbing the cold from the $CO_2$ cylinder, the thermodynamic composition 103 provides heat to the $CO_2$ cylinder 104, until the thermodynamic composition itself freezes. In one embodiment, the thermodynamic composition 103 presents a constant (e.g., 59 degree Fahrenheit) temperature of warmth, until the composition itself freezes. As discussed further herein, in certain embodiments, use of the thermodynamic composition 103 enables extended use of the $CO_2$ cylinder 104 without encountering freezing, and without requiring an active heat source to be implemented for the $CO_2$-driven device, such as an ignition heat source (e.g., a electrically-powered or pyrotechnic heat source). The thermodynamic composition 103 may, as one example, be water. Preferably, the thermodynamic composition 103 is a composition that has a higher melting point than that of water, such as a composition of water and sodium carboxymethyl cellulose. An exemplary preferred thermodynamic composition 103 that is employed in certain embodiments has approximately 98% water and approximately 2% sodium carboxymethyl cellulose.

Thus, thermodynamic composition 103 is preferably a passive composition that performs a thermal transfer/exchange for counteracting the reduced temperature resulting from the expulsion of the $CO_2$ gas from the cylinder 104. In one embodiment, the thermodynamic composition is implemented in intimate contact with at least the $CO_2$ cylinder 104 (e.g., as a sleeve, jacket, or other encasing about all or a portion of the $CO_2$ cylinder), and in certain embodiments the thermodynamic composition may further be in intimate contact with other components of the device 100, such as its hoses 107 and/or 108 and/or regulator 105.

As discussed further herein, in certain embodiments no active heat generation element is required for heating the thermodynamic composition 103 during operation of the device 100. In particular, in certain embodiments, no persistent, active heat generation element for actively heating the thermodynamic composition 103 is implemented. Thus, no electrically-powered or otherwise active heat generating element is required, in certain embodiments, in order for the thermodynamic composition 103 to act in counteracting the reduced temperatures resulting from expulsion of $CO_2$ from the cylinder 104, preferably to support substantially-continuous use thereof for a full use cycle of cylinder 104 without encountering freezing of the cylinder 104. Instead, in certain embodiments, thermodynamic composition 103 may be implemented as a fully passive heat exchange element that does not require any active heat generating element to be present for actively generating heat for heating the thermodynamic composition 103.

Thus, in certain embodiments, no electrically-powered heat generating source, or other persistent heat source for actively generating heat, is required for heating cylinder 104. For instance, no electrically-powered heat generating source is required to be implemented in device 100 for heating the thermodynamic composition 103 during operation of device 100. As such, the increased size, weight, and cost that is attributable to electrically-powered heaters (and/or batteries for powering such heaters) can be avoided, and suitability of the implementation of device 100 for use in environments that are risk-averse to electrical sparks may be enhanced.

In certain embodiments, while the device 100 does not require a persistent heat generating source, such as an electrically-powered heat generating source, a supplemental non-persistent heat generating source may be included for actively generating heat (e.g., in a non-persistent manner, such as via a limited-time heat generation resulting from a chemical reaction) to be applied to thermodynamic composition 103 or to cylinder 104. For instance, a chemically-active heat generating source may be implemented for actively heating the thermodynamic composition 103 or cylinder 104 through, for example, a chemical reaction that produces heat that is transferred to the thermodynamic composition 103 and/or cylinder 104. For instance, an exothermic chemical reaction may occur in a thermally-active composition, which may be arranged in intimate contact with thermodynamic composition 103 (e.g., via a sleeve, jacket, or other encasing (not shown in FIG. 1) about all or a portion of thermodynamic composition 103). An example of such a thermally-active composition that may be employed in certain embodiments is one such as those commonly employed in hand warmers for producing heat on demand to warm cold hands, which may be implemented to perform an exothermic oxidation of iron when exposed to air to generate heat to be transferred to the thermodynamic composition or which may be implemented to generate heat through exothermic crystallisation of supersaturated solutions, as examples. In each case, the device 100 remains electrically passive and does not require an electrically-powered heat source (or other persistent heat generating source) for actively heating the compressed gas cylinder 104 or the thermodynamic composition 103. Further, the device 100 remains ignition-passive and does not require an ignition-based heat source, such as a pyrotechnic-based heat source, that may present a fire hazard.

Again, in certain embodiments, no active heat generator is required for a desired extended use to be achieved (e.g., for a "full cylinder use cycle" to be achieved) without interruption of the device operation caused by freezing attributable to the $CO_2$. However, a supplemental active heat generator, such as those mentioned above, may be implemented in certain embodiments, if so desired, which may supplement the passive thermodynamic composition 103 and/or which may aid in reducing a "recovery period" of the passive thermodynamic composition 103 (e.g., for thawing the passive thermodynamic composition between full cylinder use cycles).

Exemplary device 100 further includes a regulator 105 for regulating the flow of the $CO_2$ from the cylinder 104. In certain embodiments, the regulator 105 is a piston-driven regulator. In a preferred embodiment, a compensating piston-driven regulator is employed. Examples of piston-driven regulators and/or compensating piston-driven regulators which may be employed include those mentioned previously herein. In the illustrated example, cylinder 104 is in communication with regulator 105 through a line (e.g., hose) 107. Of course, the line 107 may be of any length or it may be excluded and the regulator 105 may be in direct/immediate communication with the $CO_2$ cylinder 104.

Further, a device 106 that is driven by the $CO_2$ is in communication with the regulator 105 via line (e.g., hose) 108. The device 106 may, in certain embodiments, comprise a target solution and/or output interface (e.g., spray nozzle), wherein the $CO_2$ output from cylinder 104 is used as a propellant for dispensing (e.g., as a mist) the target solution. As another example, the device 106 may comprise a pneumatic tool, the operation of which is powered by the $CO_2$ dispensed from cylinder 104.

While assembly 102 is shown as implemented as part of device 100 in the example of FIG. 1, in certain embodiments, assembly 102 may be removably (e.g., interchangeably) coupled to device 100. For instance, assembly 102 may be provided as an interchangeable component that may be selectively implemented within any of numerous different compressed gas-drive devices 100. For instance, assembly 102 may be provided as an interchangeable component that may be selectively coupled to any of numerous different compressed gas-drive devices 106 for powering such devices 106. In certain embodiments, the piston-driven regulator 105 may likewise be an interchangeable component, which may be provided along with assembly 102 for use with any of number different interchangeable devices 106 to be driven by the output $CO_2$. Also, as mentioned above, in certain embodiments of the present invention, once a given $CO_2$ cylinder is emptied, the assembly 102 may be handled for refilling the $CO_2$ cylinder, and during such conventional refilling (e.g., which may include transporting the $CO_2$ cylinder to a refill location) a sufficient recovery period generally lapses for the passive thermodynamic composition that is in thermal communication with the $CO_2$ cylinder being refilled. In the meantime, while the emptied $CO_2$ cylinder of a first assembly 102 is being refilled, a standby, replacement assembly 102 (e.g., that includes a full $CO_2$ cylinder 104 and corresponding passive thermodynamic composition 103 in thermal communication therewith) may be implemented within the $CO_2$-driven device to enable continued use thereof.

Thus, in certain embodiments, the cylinder 104 may be refilled or interchanged with a new (e.g., full) cylinder. In certain embodiments, the implementation of compressed gas-driven device 100 (e.g., having thermodynamic composition 103 and piston-drive regulator 105) does not require an electrically-powered heating element, while permitting extended use thereof without freezing resulting from the extended use of the $CO_2$ being dispensed from cylinder 104. In certain embodiments, the permitted extended use of the device 100 is substantially continuous use of at least one full $CO_2$ cylinder 104. That is, a full $CO_2$ cylinder 104 may be used substantially-continuously for an extended period of time to fully empty the cylinder 104, without freezing of the $CO_2$ cylinder 104 and/or other device components (e.g., regulator 105) by the reduced temperatures resulting from the $CO_2$ usage. The extended, substantially continuous use may be uninterrupted use or intermittent use with sufficiently small delays between uses over a period of time that would otherwise lead to freezing of the $CO_2$ cylinder 104 and/or other device components if the reduced temperatures resulting from the $CO_2$ usage are not counteracted (e.g., by the thermal exchange performed by passive thermodynamic composition 103).

In certain embodiments, after substantially continuous use of a full $CO_2$ cylinder 104, some "recovery period" may be needed to enable the passive thermodynamic composition 103 to reheat before substantially continuous use of a next $CO_2$ cylinder 104 may be fully supported without potentially encountering freezing. Of course, in certain embodiments, the thermodynamic composition 103 (e.g., sleeve or encasing) may be replaced when refilling or replacing a $CO_2$ cylinder 104 so as to permit continued use without freezing from one cylinder to the next, and/or a greater ratio of thermodynamic composition 103 to cylinder size may be employed to potentially support longer substantially continuous use, which may enable a given thermodynamic encasing to counteract the reduced temperatures resulting from substantially continuous use of multiple cylinders in succession without encountering freezing.

Figure 2:
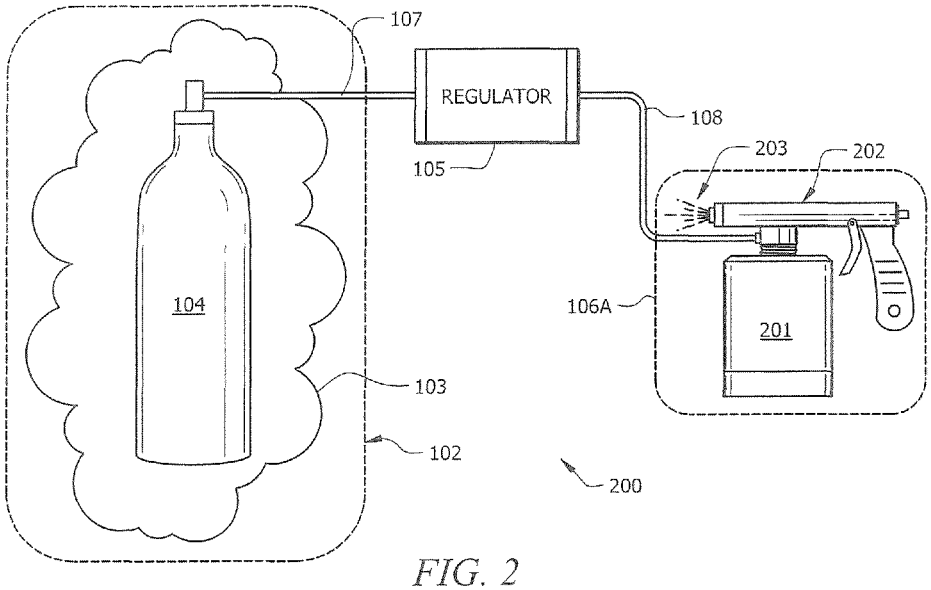
FIG. 2 shows a block diagram representation of an exemplary compressed gas-driven device implemented in accordance with one embodiment of the present invention.

FIG. 2 shows a block diagram representation of an exemplary compressed gas-driven device 200 implemented in accordance with one embodiment of the present invention. The device 200 again comprises the compressed gas power assembly 102 (that includes $CO_2$ cylinder 104 and passive thermodynamic composition 103) as discussed above with FIG. 1. Also, device 200 again comprises the piston-driven regulator (e.g., compensating piston-driven regulator) 105, as well as lines 107 and 108, as discussed above with FIG. 1. In this example, the $CO_2$-driven device (e.g., device 106 of FIG. 1) is a solution dispensing device 106A, such as a sprayer, mister, etc. In this example, the $CO_2$ output from cylinder 104 is used as a propellant for dispensing a solution via device 106A. For instance, device 106A includes a container 201 that contains a target solution to be dispensed. Device 106A further includes an output interface (e.g., spray or misting nozzle) 202, which when activated (e.g., by its user-driven or robotics-driven trigger), outputs a fine mist or spray 203 of the target solution, which is carried or propelled by the $CO_2$ output from cylinder 104. In certain embodiments, the output interface 202 is an atomizer spray gun that outputs an atomized spray or mist 203.

In one embodiment, the device 200 is a sanitizing device, where the $CO_2$ is employed as a propellant for spraying (e.g., misting) a sanitizing solution, and wherein the sanitizing device does not require any active heating source for actively heating the $CO_2$ cylinder, passive thermodynamic composition, or other device components. For instance, the exemplary sanitizing device of the illustrated embodiment does not require any electrically-powered heating element (or any other active heating element), while permitting extended use thereof without freezing resulting from the extended use of the $CO_2$. As used herein, "sanitizing" refers generally to any solution for sanitizing, disinfecting, sterilizing, and/or for acting as, without limitation, a fungicidal, antimicrobial, antibacterial, sporicidal, viricidal, tuberculocidal and/or salmonellacidal.

In certain embodiments the solution contained in container 201 may be a flammable solution, such as an alcohol-based solution, where the $CO_2$ propellant serves as a flame retardant. For instance, $CO_2$ will not burn or support combustion. As an example, cold sterilization can be carried out with a mixture of 90% $CO_2$ and 10% ethylene oxide, as an example, where the $CO_2$ has a stabilizing effect on the ethylene oxide and reduces the risk of explosion. In this way, the desirable sanitizing properties of a flammable (e.g., alcohol-based) solution may be employed without the heightened risk of fire due to the flame retardant properties of the $CO_2$ propellant. As examples, a sanitizing solution such as those disclosed in the '287 patent or in the '877 application may be implemented in container 201 for being dispensed. As a further example, a sanitizing solution, such as the Biomist™ Formula D2 sanitizer, may be implemented in container 201 for being dispensed. Other sanitizing solutions may be used in certain embodiments, including as examples Glutaraldehyde-based solutions, Phenol-based solutions, Iodophore-based solutions, Bleach-based solutions, and Quaternary Amonium-based solutions. Further, in certain embodiments, solutions other than sanitizing solutions may be implemented in container 201, such as pesticides, beverages, paint, stainer, surface treatment solution (e.g., water sealant, etc.), or various other solutions that may be desirable to dispense using the $CO_2$ propellant.

Figure 3A:
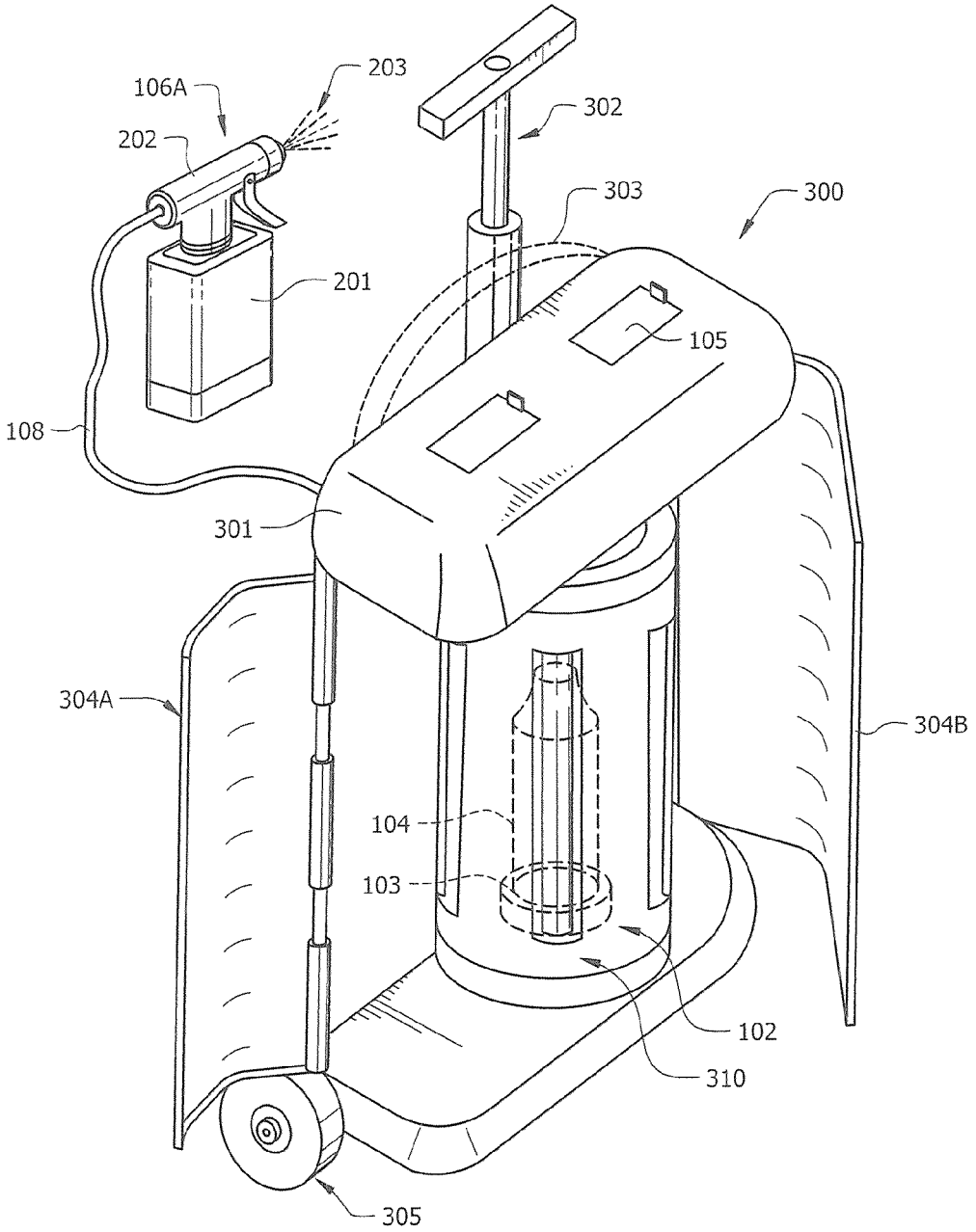
FIGS. 3A-3B show an exemplary implementation of a portable sanitizing device in accordance with one embodiment of the present invention.
Figure 3B:
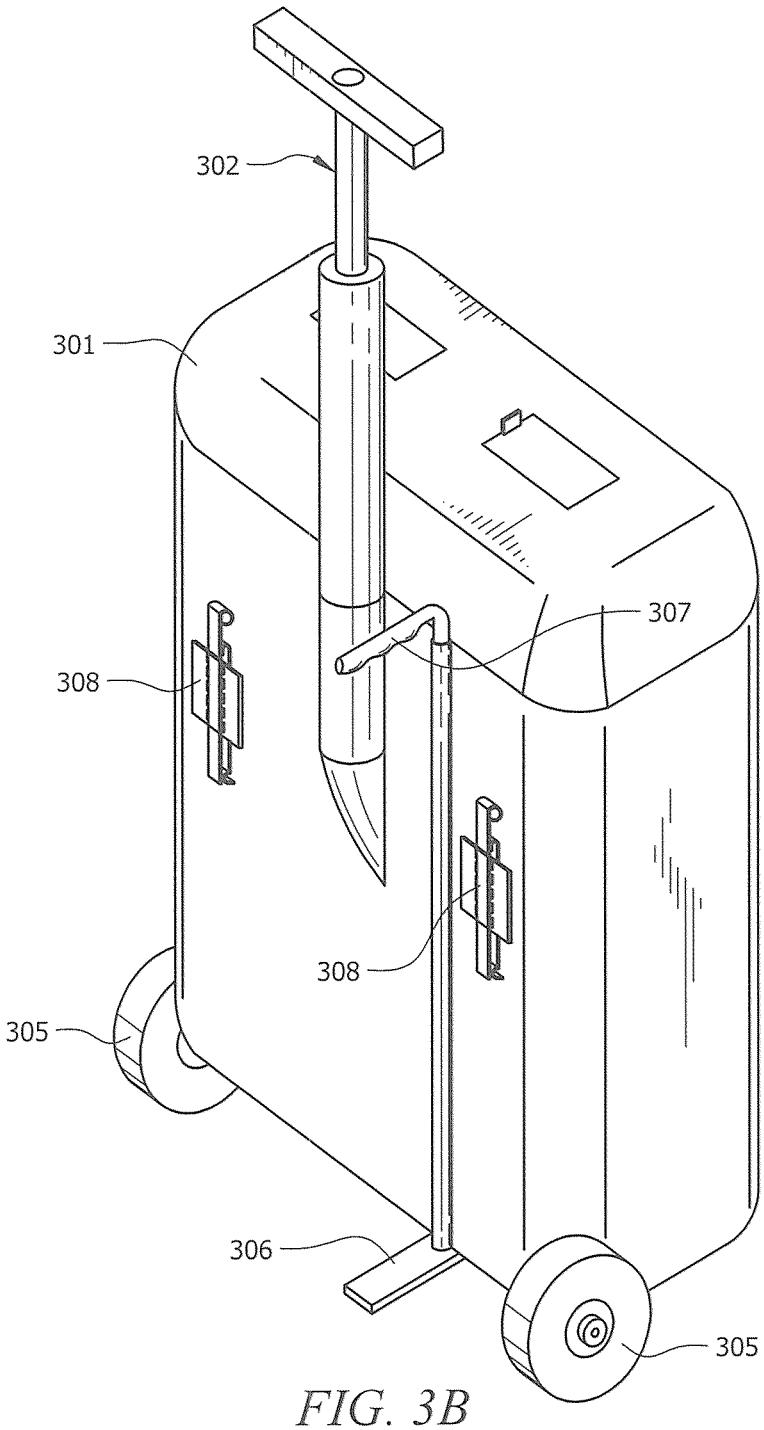

Turning to FIGS. 3A-3B, an exemplary implementation of a portable sanitizing device 300 in accordance with one embodiment of the present invention is shown. FIG. 3A shows a front view of the exemplary device 300, while FIG. 3B shows a rear view of the exemplary device 300. While described as a sanitizing device for dispensing a sanitizing solution in this example, it will be understood that the portable device 300 may instead be implemented to dispense any other desired solution. Again, in this exemplary implementation, the device 300 does not require any active heat source for heating the $CO_2$ cylinder, thermodynamic composition, or other components of device 300. For instance, in this exemplary embodiment, device 300 does not require any electrically-powered heaters (or other persistently-maintained, active heaters), and may be implemented to be completely free of any electrically-powered components.

The device 300 again comprises the compressed gas power assembly 102 (that includes $CO_2$ cylinder 104 and thermodynamic composition 103) as discussed above with FIG. 1. As shown in FIG. 3A and discussed further with FIGS. 4-5 below, in certain embodiments, the assembly 102 is implemented within a casing 310, which may be an interchangeable casing to allow the assembly 102 to be removed/replaced with another like assembly 102 within device 300.

Also, device 300 again comprises the piston-driven regulator (e.g., compensating piston-driven regulator) 105, as discussed above with FIG. 1. Also, as in the example of FIG. 2, solution dispensing device 106A is implemented, which includes a container 201 that contains a target solution to be dispensed, an output interface (e.g., spray or misting nozzle) 202 that when activated (e.g., by its user-driven trigger) outputs a fine mist or spray 203 of the target solution, which is carried or propelled by the $CO_2$ output from cylinder 104. In certain embodiments, the output interface 202 is an atomizer spray gun that outputs an atomized spray or mist 203.

In the exemplary embodiment of FIGS. 3A-3B, the portable sanitizer device 300 includes a body 301 that may be of any suitable material, such as brushed steel, aluminum, fabric, or plastic as examples. Body 301 houses many of the components of device 300, such as the compressed gas power assembly 102, which may be removably coupled within body 301. A pull handle 302, which may be a retractable pull handle similar to those commonly found on luggage, is coupled to body 301. In addition or alternatively, a strap (e.g., shoulder strap, backpack strap, handheld strap, etc.) 303 may be coupled to body 301. Further, doors 304A and 304B are included (shown in the open position in FIG. 3A), which are coupled (e.g., via a hinged-coupling) to body 301. While doors 304A and 304B are shown as rotatably-coupled to body 301 in this example, they may in other embodiments be implemented as other components for selectively permitting or restricting access to the interior of body 301, such as zippered compartments, flaps, etc. The doors may be opened/closed for selectively accessing the interior of body 301 to, for example, remove/replace/refill/repair assembly 102, and/or store/retrieve additional solution, the spray gun when not in use, the coil hose, backpack straps when not in use, and/or other supplies.

In the illustrated example, device wheels 305 are also coupled to body 301 so that a user may pull the device about via handle 302. As shown in FIG. 3B, a hand brake 306 may be included to keep the device 300 from rolling during use. In this example, brake 306 may be activated through rotating handle 307, and the brake 306 prevents the device 300 from rolling due to friction between the brake and the ground when the brake is activated. Of course, in alternative embodiments various other braking mechanisms may be implemented instead. Further, connection points 308 are included for allowing the device 300 to be mounted to a backpack, such as a standard military backpack (e.g., via known ALICE (all-purpose light-weight, individual carrying equipment) connections.

Figure 4:
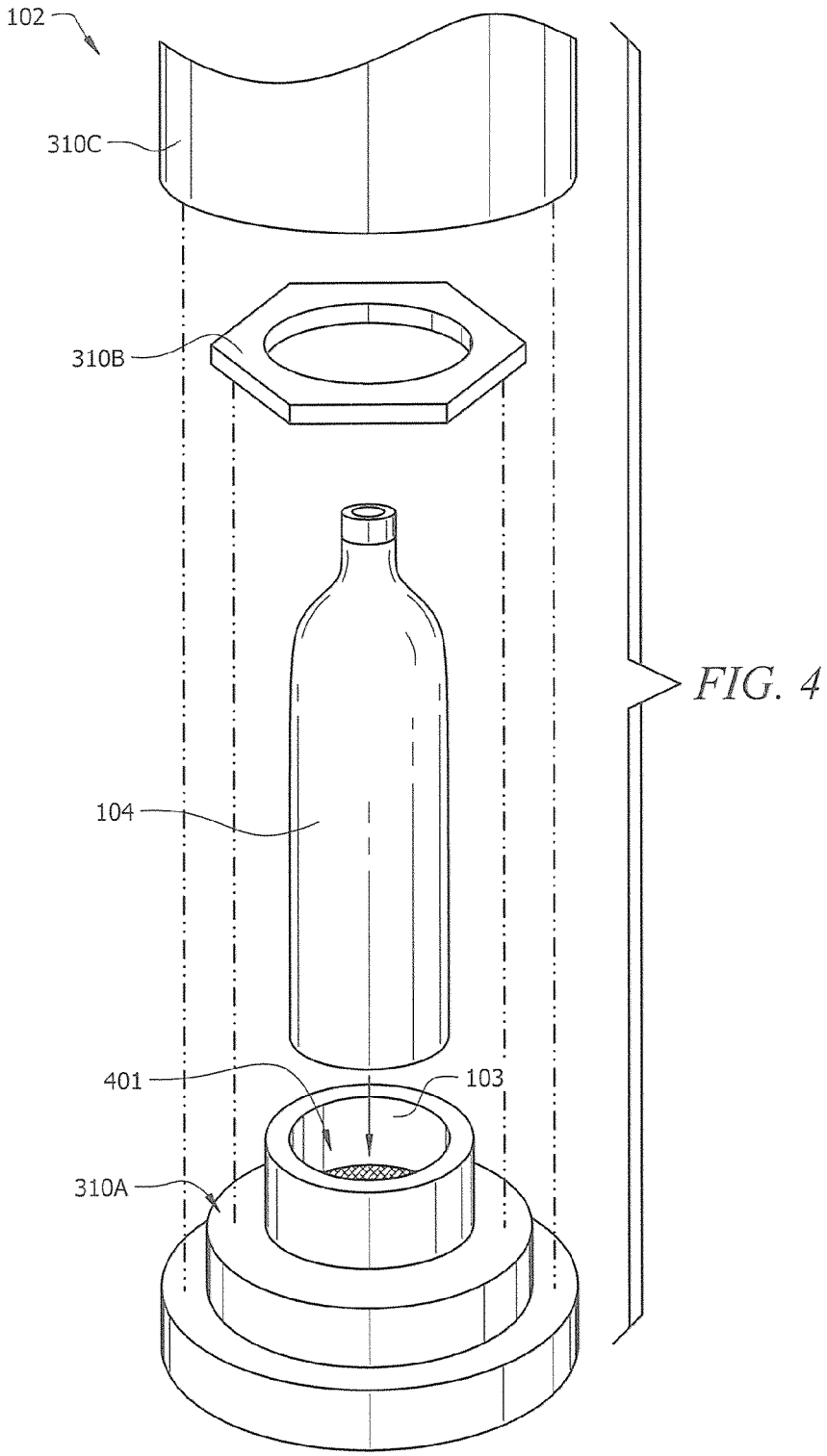
FIG. 4 shows an exploded view of one example of the compressed gas power assembly according to one embodiment of the present invention.

FIG. 4 shows an exploded view of one example of the compressed gas power assembly 102. As shown, the $CO_2$ cylinder 104 is encased in the casing 310, which may be made up of a base 310A, one or more securing rings 310B, and an outer shell 310C. As shown, in this example base 310A includes a cavity 401 in which the passive thermodynamic composition 103 may be maintained.

Figure 5:
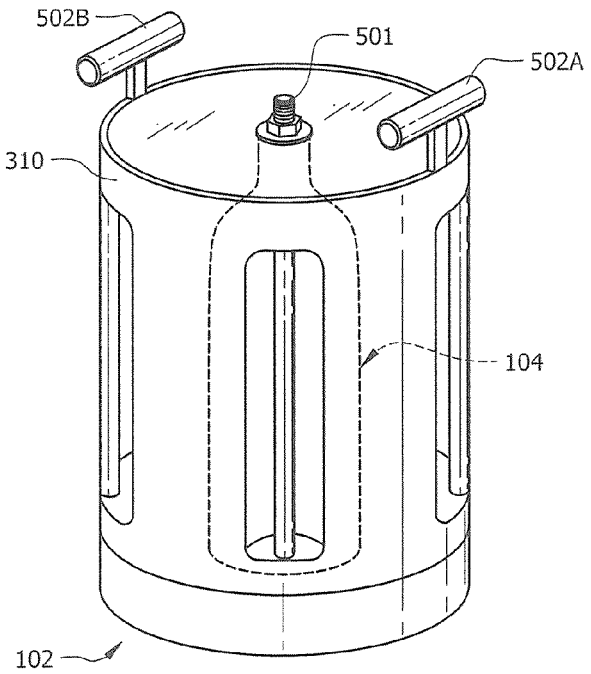
FIG. 5 shows an example of the resulting assembly of FIG. 4 after being assembled together.

FIG. 5 shows an example of the resulting assembly 102 of FIG. 4 after being assembled together. As shown, the $CO_2$ cylinder 104 is contained inside the casing 310 (e.g., within the outer shell 310C of FIG. 4). In this example, the $C_2$ cylinder's valve 501 may be exposed (e.g., may extend outside of the casing 310). Further, handles 502A and 502B and/or other guard mechanisms may be included as coupled to case 310 (or, in certain embodiments, may be coupled to cylinder 104 or cylinder valve 501, as examples), which may be used for transporting (e.g., carrying) the assembly 102, as well as serving as a guard for protecting the cylinder's valve 501 against certain types of physical impact. As mentioned above, the assembly 102 may be provided as an interchangeable assembly that may be selectively employed for powering/driving any number of different compressed gas-driven devices 106.

Figure 6:
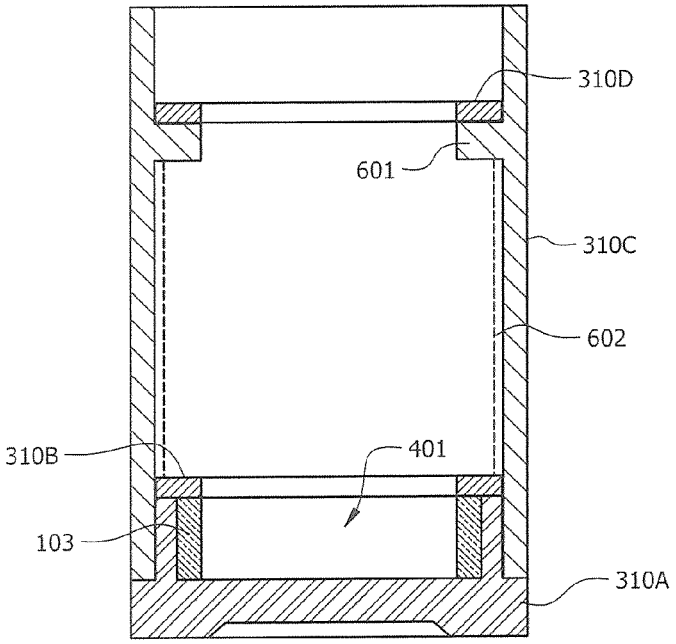
FIG. 6 shows a cross-sectional view of the exemplary assembly of FIG. 5 according to one embodiment.

FIG. 6 shows a cross-sectional view of the exemplary assembly 102 of FIG. 5. In the illustrated example, the assembly includes the base 310A, a lower securing ring 310B and an upper securing ring 310D. The assembly further includes outer shell 310C. In addition an insulator 602 may, in certain embodiments, be implemented along the interior or exterior surface of the outer shell 310C. In certain embodiments, such an insulator 602 may be omitted. The insulator 602 may be employed to aid in keeping any moisture from the atmosphere off the cylinder 104 contained within assembly 102, so that there is no condensation that forms on the outside of the cylinder 104. In addition, the insulator 602 may insulate any coldness from the cylinder from reaching the outside of the outer shell 310C to further aid in preventing condensation from forming on the outside of the shell 310C. Thus, insulator 602 may aid in preventing condensation from forming on the cylinder 104 or from forming on the outside of the outer shell 310C, which could otherwise lead to undesirable mold, etc.

In the exemplary implementation illustrated, a block ledge 601 is included for securing ring 310D. In certain embodiments, such block ledge 601 may be omitted or replaced with some other locking or securing mechanism. For instance, in certain embodiments securing rings 310B and/or 310D may be secured as glue-down rings and/or PVC/plastic-welded rings. In addition to or instead of employing and adhesive (e.g., glue), other mechanisms may be employed for securely fastening the rings within the assembly, such as by employing deep-threaded securing screws. Any of various different ways may be employed for securing the components of the assembly together.

Again, in this example base 310A includes cavity 401 which contains a passive thermodynamic composition 103 that is in intimate contact with the cylinder 104. The passive thermodynamic composition 103 may be any suitable composition that performs a thermal exchange with the cylinder 104. As one example, the composition 103 may be water. Preferably, the composition 103 is a liquid substance that has a higher melting point than water. One such passive thermodynamic composition 103 that may be employed in certain embodiments is a composition of water and sodium carboxymethyl cellulose, which has a higher melting point than water. An exemplary preferred thermodynamic composition 103 that is employed in certain embodiments has approximately 98% water and approximately 2% sodium carboxymethyl cellulose. Of course, any of various other suitable thermodynamic compositions may likewise be employed in alternative embodiments. The thermodynamic composition 103 may be implemented within an enclosing container, such as within a sealed plastic bag or other non-insulating container via which thermal communication can occur. Thus, such a non-insulating enclosing container that contains the thermodynamic composition may be arranged in cavity 401 to be in thermal communication with cylinder 104. In other embodiments, thermodynamic composition 103 may be a solution that is filled in cavity 401 and which is held in direct contact with cylinder 104 (rather than being contained in a non-insulating container that is arranged in thermal communication with cylinder 104). In either implementation, thermodynamic composition 103 is considered herein as being in thermal communication with cylinder 104 (e.g., via intimate contact either directly with cylinder 104 or through a non-insulating container).

Various different size of cylinders 104 may be implemented in different embodiments. Preferably, a suitable amount of passive thermodynamic composition 103 is included to enable substantially continuous use of the $CO_2$ cylinder for driving a device over a period of time for fully emptying the complete cylinder without freezing. Exemplary cylinder sizes and corresponding amount of the above-mentioned thermodynamic composition formed by approximately 98% water and approximately 2% sodium carboxymethyl cellulose that may be employed in a preferred embodiment for enabling substantially continuous use of the $CO_2$ cylinder for driving a device over a period of time for fully emptying the complete cylinder (i.e., a "full cylinder use cycle") without freezing are shown below in Table 1. Of course, other amounts of this or other thermodynamic compositions may be employed in alternative embodiments, and the embodiments of the invention are not limited to use of the exemplary cylinder sizes shown in Table 1.

TABLE 1

| $CO_2$ Cylinder Size (lb) | Preferred Thermodynamic Composition Amount (oz) |
|---|---|
| 20 lb. | 80 |
| 10 lb. | 32 |
| 5 lb. | 24 |
| 2.5 lb. | 12 |

A composition of water and sodium carboxymethyl cellulose has been employed in other types thermodynamic applications. Traditionally, such thermodynamic composition has been used ice packs or gel packs for freezing, where a pack containing the composition is placed into a freezer to actively freeze the pack, and because the composition has a higher melting point than water, the frozen pack can then be used as a good cooling agent for transferring the cold to some other item, such as a food product within an insulated cooler. In such an application, the intent is not to remove/absorb cold from the freezer (as the electrically-powered freezer is actively chilling its environment), but instead the intent is to capture the cold in the gel pack for transferring/pushing the cold temperature to another targeted item, such as a food product stored in an insulated cooler. Thus, such a conventional use of the thermodynamic composition is opposite its application in the exemplary embodiments described herein. That is, the conventional use actively freezes the composition and then utilizes the frozen composition to communicate cold (e.g., as it thaws) to a targeted item, whereas the thermodynamic composition's application in the exemplary embodiments described herein is for passively absorbing cold from components of the compressed gas-driven device (e.g., a $CO_2$ cylinder).

Figure 7A:
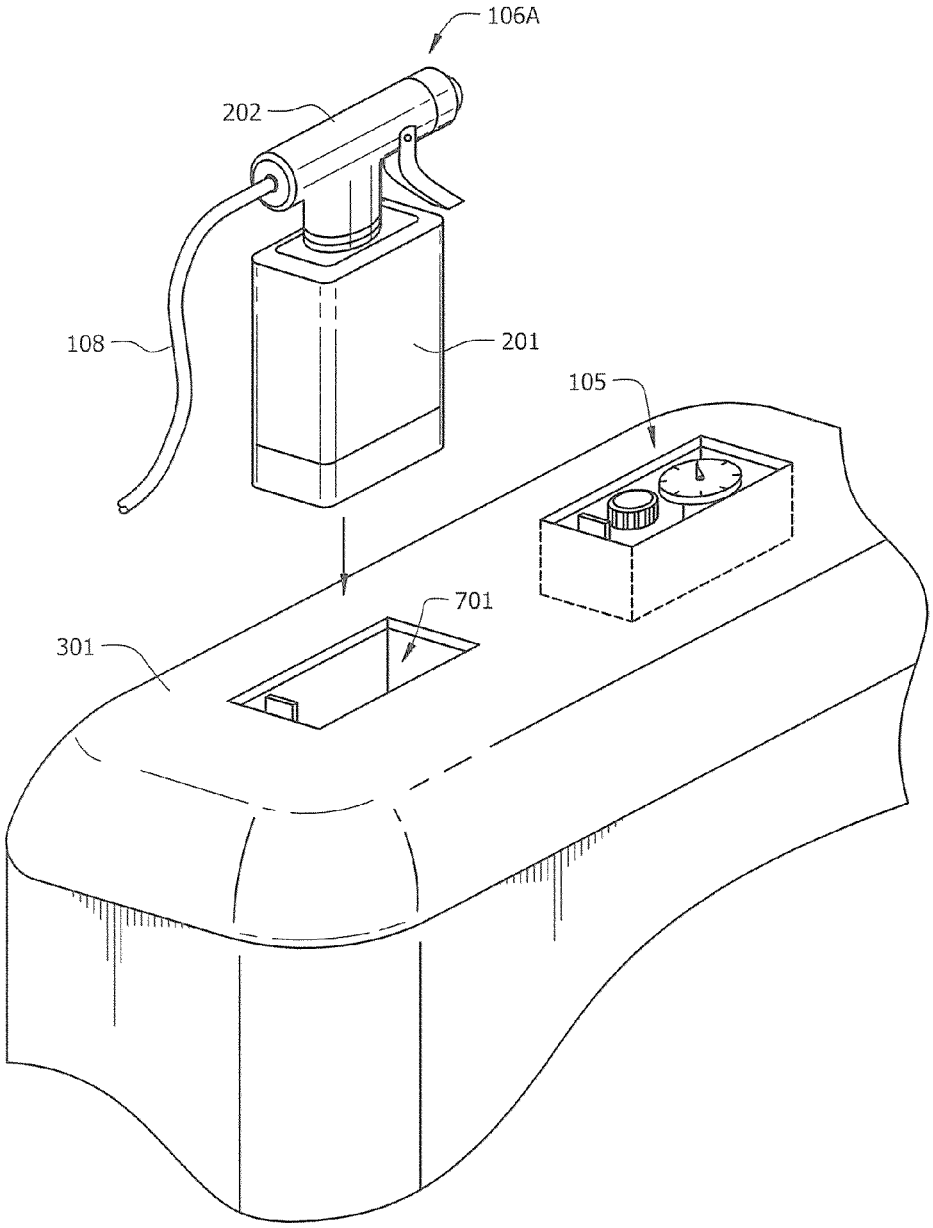
FIGS. 7A and 7B show an exemplary implementation of a portion of the portable sanitizing device of FIG. 3 according to one embodiment, namely the piston-driven regulator portion.
Figure 7B:
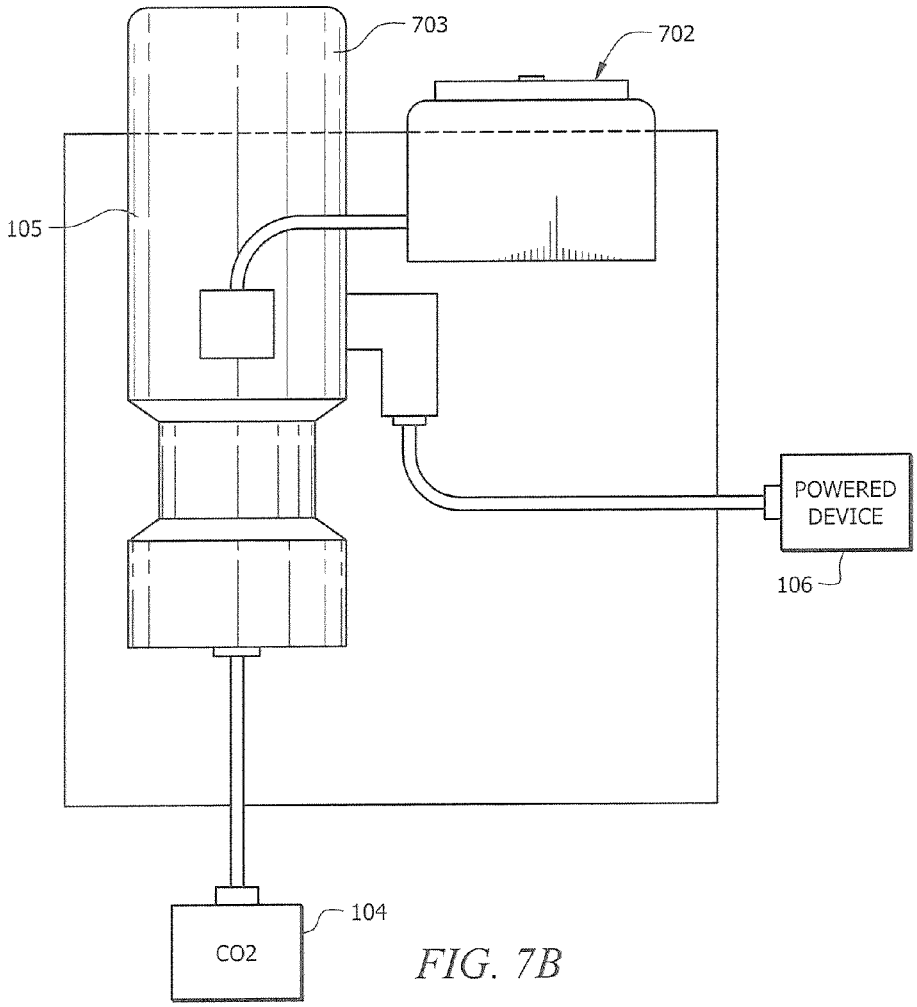

FIGS. 7A and 7B show an exemplary implementation of a portion of the portable sanitizing device 300 of FIG. 3 according to one embodiment, namely the piston-driven regulator portion. As shown in FIG. 7A, a piston-driven regulator (preferably, a compensating piston-driven regulator) 105 and any attendant gauges implemented therewith may be implemented on body 301. Further, as shown in FIG. 7A, a containment compartment 701 may be included, which may have a retractable/slidable door, wherein solution dispensing device 106A may be held in place in such compartment 701 when not in use.

FIG. 7B illustrates an exemplary block diagram representation of the regulator 105. As shown, regulator 105 may be coupled to a pressure knob 703 that allows a user to manually adjust the pressure, and regulator 105 may also be coupled to an output gauge 702 for displaying the pressure to a user. Regulator 105 may include an intake union that is connected to the $CO_2$ cylinder 104, and regulator 105 may further include an outlet union that is providing the regulated flow of $CO_2$ to the powered device 106, which in the example of FIGS. 7A-7B would be the solution dispensing device 106A.

The exemplary embodiment of a portable sanitizing device 300 discussed above with FIGS. 3A-3B, 4-6, and 7A-7B may provide many benefits that are desirable for use in many applications. For instance, the exemplary embodiment does not require an active heat source for actively heating the cylinder, thermodynamic composition, or other components of the device 300. Without such an active heat source being required, the passive thermodynamic composition 103 enables extended use of the device 300. For instance, in certain embodiments, the thermodynamic composition 103 is in sufficient ratio to the size of the cylinder 104 so as to permit substantially continuous use of the $CO_2$ cylinder 104 for driving the solution-dispensing interface over a period of time for fully emptying the complete cylinder 104 (i.e., a "full cylinder use cycle") without operation of the device being interrupted due to freezing of the cylinder or other device components. Because electrical power is not required (e.g., for an electrically-powered heater), the exemplary embodiment eliminates the power cord tethering or battery requirement of many devices, as well as eliminates the potential fire hazard associated with electrical sparks (or those associated with other ignition-based heat sources). Further, a persistent, active heater (such as an electrically-powered heater) is not required, thus eliminating the added weight and bulk that is associated with having such heaters, as well as not requiring the electrical power for powering such persistent, active heaters. In addition, the exemplary embodiment may be implemented substantially more cost effectively than traditional $CO_2$-driven sanitizing devices that implement on-board electrically-powered heaters, such as the Biomist™ Power Sanitizing System commercially available from Biomist, Inc. (see www.biomistinc.com). Various industries, such as healthcare, food service, manufacturing facilities, packaging facilities, correctional institutions, athletic or fitness facilities, educational institutions, and cruise liners may find it particularly desirable to use of such a portable sanitizing device 300 that does not require electrical power, but which supports substantially continuous use for extended periods of time (e.g., at least for the time required for the use to completely empty a full on-board $CO_2$ cylinder) without freezing being encountered to disrupt operation of the device.

Figure 8:
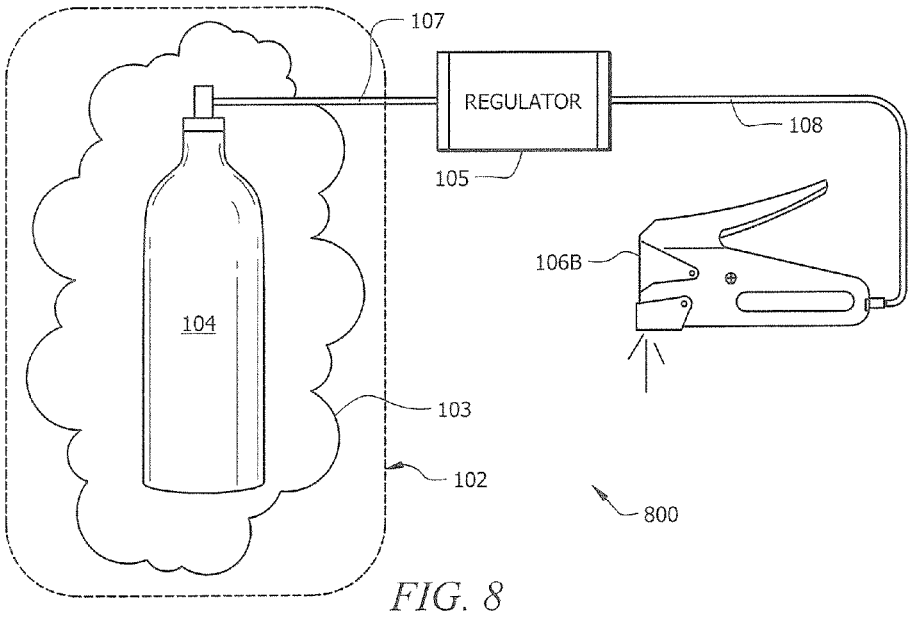
FIG. 8 shows an exemplary implementation of a device for use in the construction industry, where the end device being powered by the $CO_2$ is a pneumatic staple gun (or nail gun)
Figure 9:
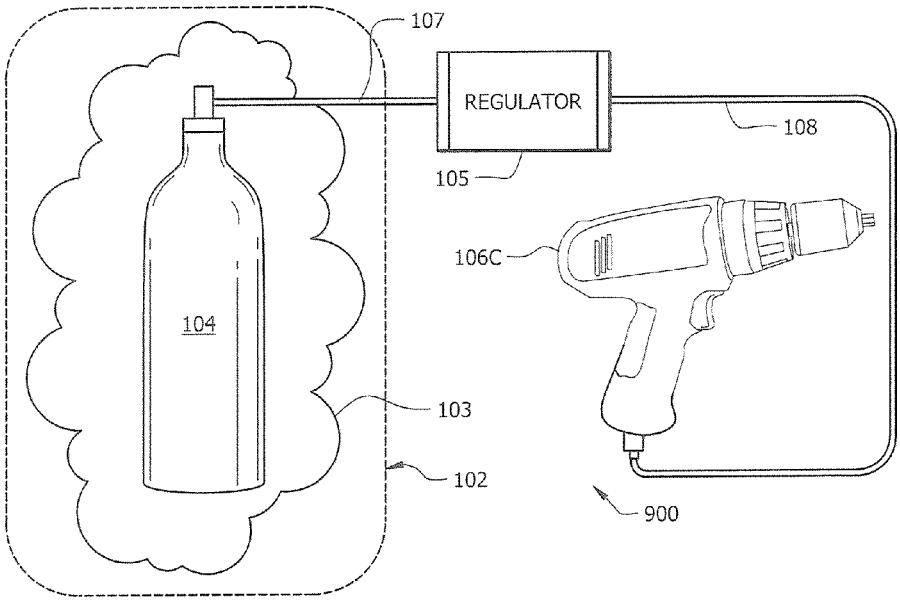
FIG. 9 shows another exemplary implementation of a device, where the end device being powered by the $CO_2$ is a pneumatic wrench that may be used for mechanical repairs.
Figure 10:
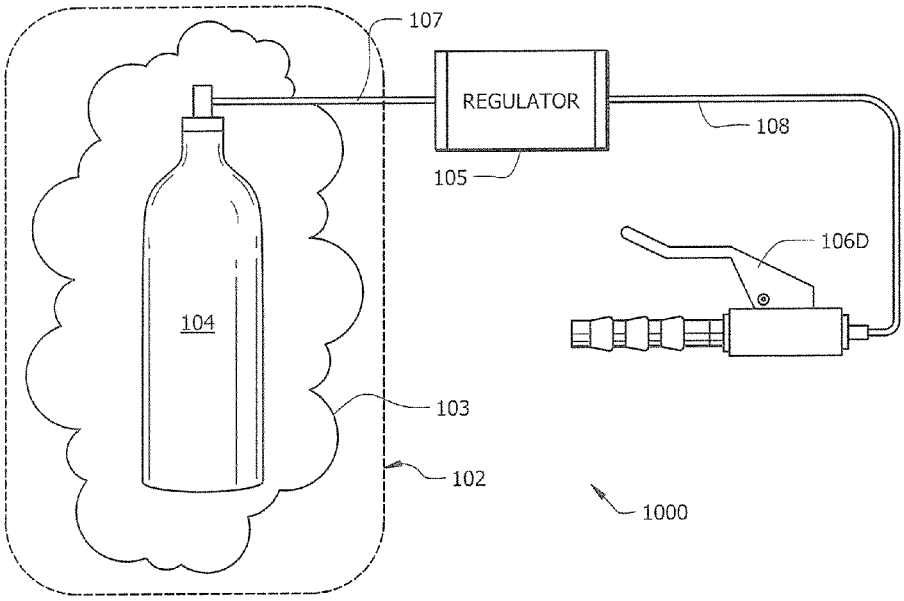
FIG. 10 shows another exemplary implementation of a device, where the end device being powered by the $CO_2$ is an air chuck that may be used for airing up tires, etc.

While certain embodiments are implemented in which the $CO_2$ serves as a propellant for dispensing a solution, such as a sanitizing solution, embodiments of the present invention may be implemented for driving any $CO_2$-driven device, such as pneumatic tools, etc. FIG. 8 shows an exemplary implementation of a device 800 for use in the construction industry, where the end device being powered by the $CO_2$ is a pneumatic staple gun (or nail gun) 106B. FIG. 9 shows another exemplary implementation of a device 900, where the end device being powered by the $CO_2$ is a pneumatic wrench 106C that may be used for mechanical repairs. FIG. 10 shows another exemplary implementation of a device 1000, where the end device being powered by the $CO_2$ is an air chuck 106D that may be used for airing up tires, etc.

Figure 11:
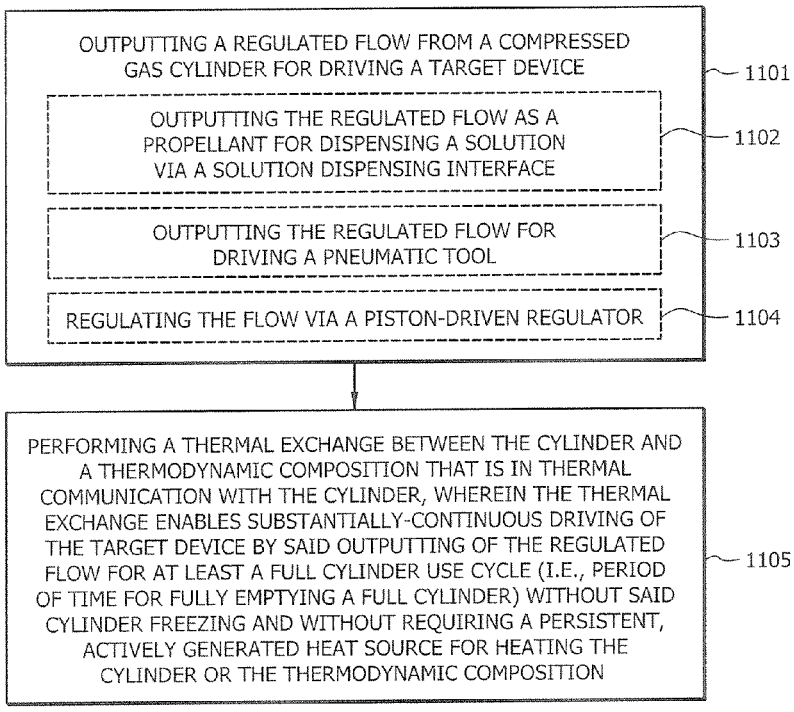
FIG. 11 shows an exemplary operational flow diagram for one embodiment of the present invention.

FIG. 11 shows an exemplary operational flow diagram for one embodiment of the present invention. As shown, in operational block 1101, a regulated flow is output from a compressed gas cylinder (e.g., a compressed liquefied $CO_2$ cylinder) for driving a target device. As shown in optional sub-block 1102, in certain embodiments, the output flow drives a solution dispensing interface, such as a sprayer, where the output flow serves as a propellant for dispensing the solution, such as a sanitizing solution. As shown in optional sub-block 1103, in certain embodiments, the output flow drives a pneumatic tool. As shown in optional sub-block 1104, in certain embodiments, a piston-driven regulator (e.g., a compensating piston-driven regulator) regulates the flow output from the cylinder.

Further, in operational block 1105, a thermal exchange is performed between the cylinder and a thermodynamic composition that is in thermal communication with the cylinder, wherein the thermal exchange enables substantially-continuous driving of the target device by the regulated flow for extended use without freezing of the cylinder. For instance, in certain embodiments, the thermal exchange enables substantially-continuous driving of the target device by the regulated flow for at least a full cylinder use cycle without the cylinder freezing to a point that interrupts operation of the device. Further, according to certain embodiments, the thermodynamic composition is passive and does not require a persistent, actively generated heat source for heating the cylinder or the thermodynamic composition. For instance, an electrically-powered heater is not required for heating the cylinder or the thermodynamic composition or any other component of the compressed gas-driven device. As mentioned further herein, in certain embodiments, a further active heat generator may be employed to supplement the passive thermodynamic composition which may be a non-persistent heat generator that is not electrically powered and/or that is not an ignition-based heat source, such as heat generated by a triggered chemical reaction (e.g., where such generated heat aids in prolonging the period of extended use of the cylinder without freezing, but dissipates over time, rather than being persistently maintained as with an electrically-powered heat source). Again, such a supplemental active source is not a requirement for certain embodiments in order for enabling substantially continuous use of the $CO_2$ cylinder for driving a device over a period of time for fully emptying the complete cylinder (i.e., a "full cylinder use cycle") without freezing.

While FIGS. 1-10 show exemplary embodiments where assembly 102 comprises a compressed gas cylinder (e.g., $CO_2$ cylinder) 104 and thermodynamic composition 103, in certain embodiments additional components may be included within assembly 102. For instance, while FIGS. 1-10 show exemplary embodiments in which regulator 105 is implemented external to assembly 102, in certain embodiments assembly 102 may further include regulator 105 therein.

Figure 12:
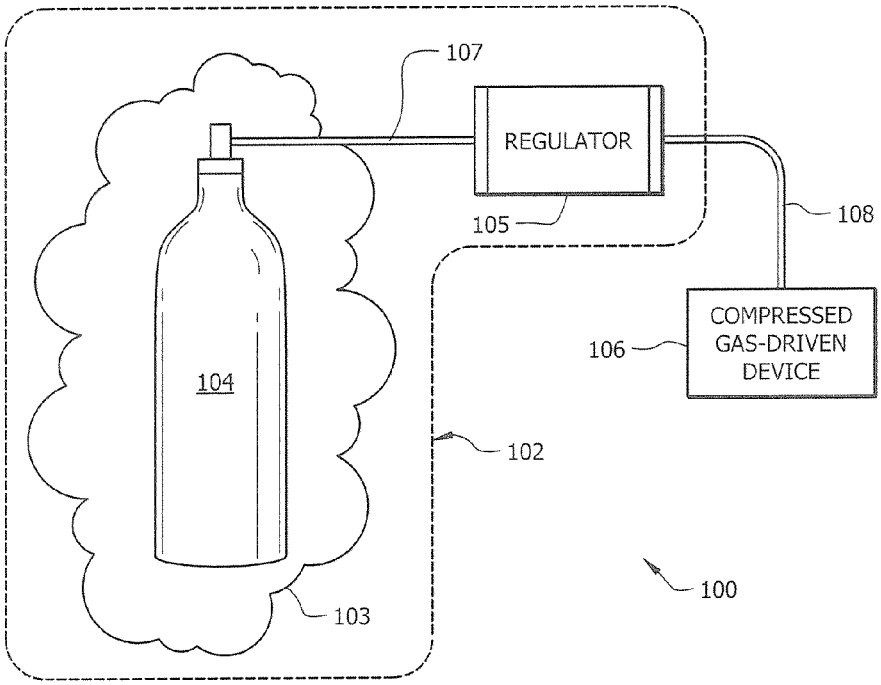
FIG. 12 shows a block diagram representation of an exemplary compressed gas-driven device implemented in accordance with one embodiment of the present invention.

As an example, FIG. 12 shows a block diagram representation of an exemplary compressed gas-driven device 100, such as that of FIG. 1 discussed above, which is implemented in accordance with one embodiment of the present invention in which assembly 102 further includes regulator 105. Thus, in this embodiment, device 100 comprises a compressed gas power assembly 102 that includes a compressed gas cylinder 104 that contains liquefied compressed gas, such which in this example is $CO_2$. Of course, as discussed above, in other embodiments the liquefied compressed gas utilized may be any other suitable gas appropriate for a given application, such as nitrogen or other inert gas, for example. In this example, cylinder 104 is implemented as a standard type cylinder.

Assembly 102 further contains a passive thermodynamic composition 103 that is implemented in thermal communication with the cylinder 104. Thermodynamic composition 103 may be implemented within a sleeve, jacket, or other encasing about all or a portion of cylinder 104, which holds the passive thermodynamic composition 103 in a suitable positional relationship with respect to cylinder 104 to permit a thermal exchange to occur between the cylinder 104 and passive thermodynamic composition 103.

This exemplary embodiment of device 100 further includes a regulator 105 for regulating the flow of the $CO_2$ from the cylinder 104, wherein regulator 105 is implemented as part of assembly 102. As discussed above, in certain embodiments, the regulator 105 is a piston-driven regulator. In a preferred embodiment, a compensating piston-driven regulator is employed. In the illustrated example, cylinder 104 is in communication with regulator 105 through a line (e.g., hose) 107. Of course, the line 107 may be of any length or it may be excluded and the regulator 105 may be in direct/immediate communication with the $CO_2$ cylinder 104.

Further, a device 106 that is driven by the $CO_2$ is in communication with the regulator 105 via line (e.g., hose) 108. The device 106 may, in certain embodiments, comprise a target solution and/or output interface (e.g., spray nozzle), wherein the $CO_2$ output from cylinder 104 is used as a propellant for dispensing (e.g., as a mist) the target solution. As another example, the device 106 may comprise a pneumatic tool, the operation of which is powered by the $CO_2$ dispensed from cylinder 104, such as any of the exemplary tools/devices discussed above with FIGS. 8-10.

While assembly 102 is shown as implemented as part of device 100 in the example of FIG. 12, in certain embodiments, assembly 102 may be removably (e.g., interchangeably) coupled to device 100. For instance, assembly 102 may be provided as an interchangeable component that may be selectively implemented within any of numerous different compressed gas-drive devices 100. For instance, assembly 102 may be provided as an interchangeable component that may be selectively coupled to any of numerous different compressed gas-driven devices 106 for powering such devices 106. Also, as mentioned above, in certain embodiments of the present invention, once a given $CO_2$ cylinder is emptied, the assembly 102 may be handled for refilling the $CO_2$ cylinder, and during such conventional refilling (e.g., which may include transporting the $CO_2$ cylinder to a refill location) a sufficient recovery period generally lapses for the passive thermodynamic composition that is in thermal communication with the $CO_2$ cylinder being refilled. In the meantime, while the emptied $CO_2$ cylinder of a first assembly 102 is being refilled, a standby, replacement assembly 102 (e.g., that includes a full $CO_2$ cylinder 104 and a corresponding passive thermodynamic composition 103 and regulator 105) may be implemented within the $CO_2$-driven device to enable continued use thereof. In certain embodiments, rather than interchanging the entire assembly 102, the $CO_2$ cylinder 104 and/or thermodynamic composition 103 may be changed within the assembly (e.g., to replace the cylinder with a full cylinder).

Figure 13:
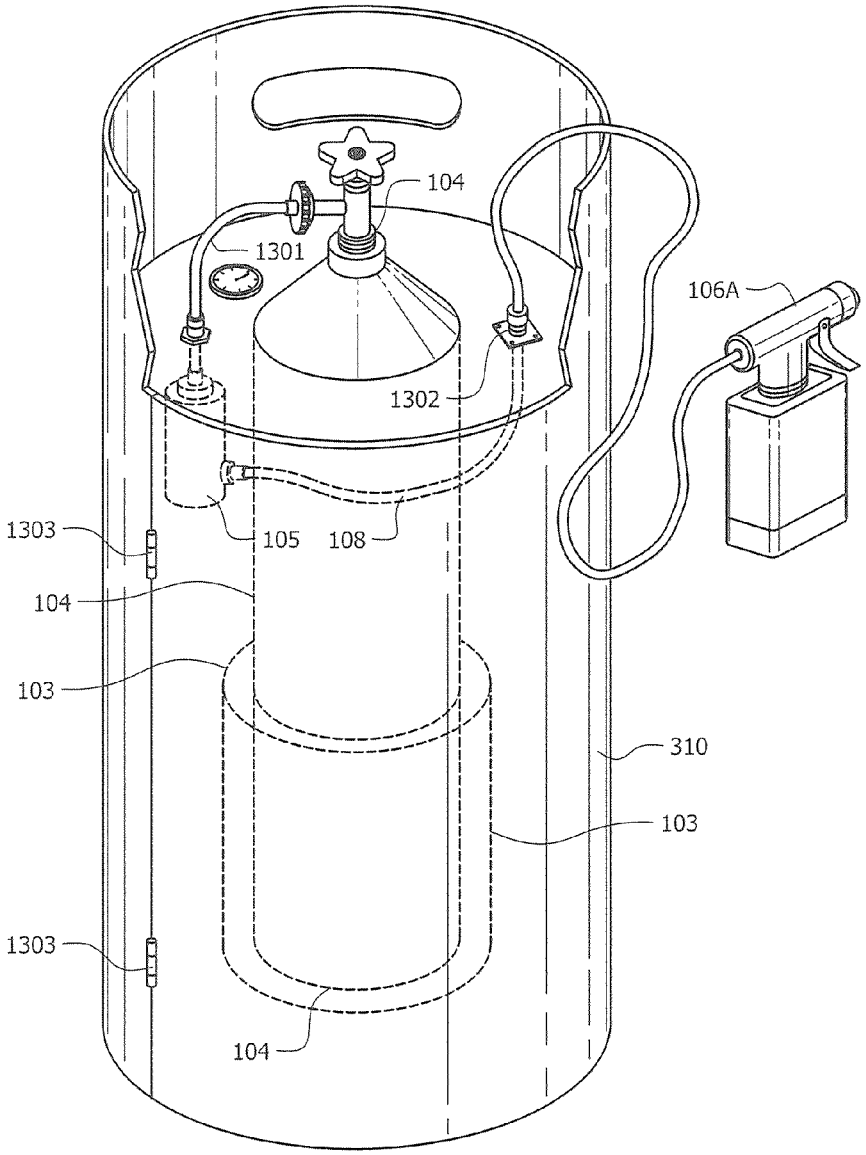
FIG. 13 shows an exemplary implementation of a compressed gas power assembly according to one embodiment of the present invention to which an end device (e.g., solution dispensing device) is coupled in order to be powered by the power assembly.

FIG. 13 shows one exemplary implementation of the embodiment of FIG. 12. In this example, a casing 310 is implemented, which encases assembly 102 of FIG. 12. Thus, $CO_2$ cylinder 104, thermodynamic composition 103, and regulator 105 are contained within casing 310. Casing 310 may, in certain embodiments, be implemented within a portable body, such as within body 301 of the example of FIG. 3. Indeed, in certain embodiments casing 310 itself may be implemented as a user-portable body 301. For instance, casing 310 may be configured as a backpack shell or as some other user-portable shell, such as a hand-carried or rolled shell (having wheels and a handle, such as body 301 of FIG. 3).

In the illustrated example of FIG. 13, an output end of $CO_2$ cylinder 104 protrudes from the top of casing 310. That is, similar to the exemplary implementation of FIG. 5, the $CO_2$ cylinder's valve may be exposed (e.g., may extend outside of the casing 310). A line (e.g., hose) 1301 communicatively couples the cylinder 104 to regulator 105, which is contained within casing 310. Line (e.g., hose) 108 communicatively couples from regulator 105 to an output terminal 1302 that is provided as an interface on casing 310. Thus, a device to be powered via a regulated flow of $CO_2$ supplied by $CO_2$ cylinder 104 may be coupled to output terminal 1302. For instance, in the illustrated example of FIG. 13, a solution dispensing device 106A, such as a sprayer, mister, etc. is coupled to output terminal 106A. Thus, in the illustrated example of FIG. 13, the $CO_2$ output via output terminal 1302 is used as a propellant for dispensing a solution via device 106A, such as discussed above with FIG. 2. Of course, in other embodiments, any other type of device to be powered by $CO_2$ (such as a pneumatic tool, etc.) may be coupled to output terminal 1302.

As shown in the exemplary implementation of FIG. 13, in certain embodiments, the casing 310 may include a hinged door (e.g., coupled via hinges 1303) or other mechanism that selectively permits access to the interior of the casing 310, which may be opened to permit a user to selectively refill or replace (or otherwise perform maintenance) on one or more of the cylinder 104, thermodynamic composition 103, and regulator 105 contained therein.

Further, in certain embodiments the casing 310 which houses the cylinder 104, thermodynamic composition 103, and in certain embodiments regulator 105, may be implemented as a moisture-tight assembly, which may include one or more gaskets (not shown in the figures) for forming a moisture-tight seal. Such moisture-tight seal may aid in reducing or effectively eliminating the presence of moisture within the casing 310, which may in turn reduce the presence of mold, etc. from forming therein.

In certain embodiments, the casing 310 may be of a plastic, metal (e.g., aluminum, stainless steel, etc.), or other suitable material desired for a given application. Also, as mentioned above, in certain implementations, an insulator (e.g., insulator 602 of FIG. 6) may be implemented within the casing 310 that houses the cylinder 104, thermodynamic composition 103, and in certain embodiments regulator 105. Such an implementation of an insulator may be particularly desirable in an embodiment in which casing 310 is of a material that is a good conductor of thermal energy, such as of a metal material, so as to reduce the forming of condensation on the outer surface of casing 310.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A compressed gas power assembly for use in driving a compressed gas-driven device, the assembly comprising:

a cylinder storing compressed gas;

a passive thermodynamic composition for performing a thermal exchange with the cylinder to counteract a reduced temperature resulting from expulsion of said gas from said cylinder and enable substantially-continuous driving of the compressed gas-driven device by output from the cylinder for at least a full cylinder use cycle without said cylinder freezing;

a regulator communicatively coupled with the cylinder for outputting a regulated flow;

a casing containing said cylinder, passive thermodynamic composition, and regulator; and a supplemental non-persistent, active heat generation source that does not require electrical power and that is adapted to generate heat between full cylinder use cycles.

2. The assembly of claim 1 wherein said casing structurally holds the thermodynamic composition in thermal communication with the cylinder.

3. The assembly of claim 2 wherein the casing structurally holds the passive thermodynamic composition in intimate contact with the cylinder, and wherein the passive thermodynamic composition performs a bi-directional thermal exchange with the cylinder.

4. The assembly of claim 3 wherein said thermodynamic composition comprises a volume in relation to a size of said cylinder to provide a sufficient thermal exchange between said thermodynamic composition and said cylinder in an ambient environment.

5. The assembly of claim 4 wherein said volume in relation to said size of said cylinder comprises one of the following:

at least 80 ounces of said thermodynamic composition for a 20 pound cylinder;

at least 32 ounces of said thermodynamic composition for a 10 pound cylinder;

at least 24 ounces of said thermodynamic composition for a 5 pound cylinder; and at least 12 ounces of said thermodynamic composition for a 2.5 pound cylinder.

6. The assembly of claim 1 wherein said regulator comprises:

a piston-driven regulator for regulating output pressure for dispensing said gas from said cylinder.

7. The assembly of claim 6 wherein said piston-driven regulator comprises a compensating piston-driven regulator.

8. The assembly of claim 1 wherein said compressed gas stored in said cylinder comprises liquefied compressed gas.

9. The assembly of claim 1 wherein said compressed gas stored in said cylinder comprises carbon dioxide ($CO_2$).

10. The assembly of claim 1 further comprising:

a supplemental heat generation source that does not require electrical power and that is adapted to generate heat between full cylinder use cycles.

11. The assembly of claim 10 wherein the supplemental heat generation source generates heat that is in thermal communication with at least one of the passive thermodynamic composition, the cylinder, and the regulator.

12. The assembly of claim 11 wherein the supplemental heat generation source performs an exothermic chemical reaction.

13. The assembly of claim 1 wherein said assembly does not require electrical power.

14. The assembly of claim 1 further comprising:

an insulator.

15. The assembly of claim 14 wherein the insulator is disposed between the thermodynamic composition and the casing.

16. The assembly of claim 1 wherein said thermodynamic composition comprises water and sodium carboxymethyl cellulose.

17. A carbon dioxide ($CO_2$)-driven device comprising:

an electrically-passive $CO_2$-power assembly containing a) a cylinder storing $CO_2$, b) a passive thermodynamic composition in thermal communication with said cylinder for performing a thermal exchange with said cylinder to counteract a reduced temperature resulting from expulsion of said $CO_2$ from said cylinder and enable substantially-continuous driving of the device by output from the cylinder for at least a full cylinder use cycle without said cylinder freezing;

c) a piston-driven regulator for regulating output flow from the cylinder; and a device that is driven by said output flow from said cylinder; and d) a supplemental non-persistent, active heat generation source that does not require electrical power and that is adapted to generate heat between full cylinder use cycles.

18. The $CO_2$-driven device of claim 17 wherein the passive thermodynamic composition performs a bi-directional thermal exchange with the cylinder in that the thermodynamic composition absorbs cold from the cylinder and transfers heat to the cylinder.

* * * * *

UNITED STATES PATENT AND TRADEMARK OFFICE

CERTIFICATE OF CORRECTION

PATENT NO. : 8,833,078 B2
APPLICATION NO. : 12/420531
DATED : September 16, 2014
INVENTOR(S) : Daniel Galloway et al.

It is certified that error appears in the above-identified patent and that said Letters Patent is hereby corrected as shown below:

In the Specification

At column 1, line number 18, delete “devices” and replace with --devices,--.
At column 1, line number 65, delete “tar-et” and replace with --target--.
At column 2, line number 41, delete “instance” and replace with --instance,--.
At column 2, line number 47, delete “revised.” and replace with --revised,--.
At column 3, line number 12, delete “liquid” and replace with --liquid,--.
At column 5, line number 36, delete “example” and replace with --example,--.
At column 5, line number 42, delete “patent” and replace with --patent,--.
At column 5, line number 64, delete “column 2” and replace with --column 2,--.
At column 13, line number 1, delete “bidirectional” and replace with --bi-directional--.
At column 13, line number 18, delete “awhile” and replace with --while--.
At column 14, line number 16, delete “embodiments” and replace with --embodiments,--.
At column 15, line number 1, delete “’412” and replace with --’412,--.
At column 21, line number 21, delete “embodiments” and replace with --embodiments,--.
At column 22, line number 62, delete “$C_2$” and replace with --$CO_2$--.
At column 23, line number 12, delete “addition” and replace with --addition,--.
At column 26, line number 37, delete “composition” and replace with --composition,--.

Signed and Sealed this
Twenty-third Day of December, 2014

Michelle K. Lee

Michelle K. Lee
*Deputy Director of the United States Patent and Trademark Office*